US011149753B2

(12) United States Patent
Takahashi et al.

(10) Patent No.: US 11,149,753 B2
(45) Date of Patent: Oct. 19, 2021

(54) HYDRAULIC ENERGY RECOVERY APPARATUS FOR WORKING MACHINE

(71) Applicant: Hitachi Construction Machinery Co., Ltd., Tokyo (JP)

(72) Inventors: Kiwamu Takahashi, Moriyama (JP); Seiji Hijikata, Tsukuba (JP); Masatoshi Hoshino, Tsuchiura (JP); Yuichi Ogawa, Tsuchiura (JP); Kouji Ishikawa, Kasumigaura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 79 days.

(21) Appl. No.: 16/492,368

(22) PCT Filed: May 18, 2018

(86) PCT No.: PCT/JP2018/019335
§ 371 (c)(1),
(2) Date: Sep. 9, 2019

(87) PCT Pub. No.: WO2019/049436
PCT Pub. Date: Mar. 14, 2019

(65) Prior Publication Data

US 2021/0131452 A1 May 6, 2021

(30) Foreign Application Priority Data

Sep. 11, 2017 (JP) ..... JP2017-174066

(51) Int. Cl.
*F15B 1/08* (2006.01)
*E02F 9/22* (2006.01)
*F15B 21/14* (2006.01)

(52) U.S. Cl.
CPC ..... *F15B 1/08* (2013.01); *E02F 9/2217* (2013.01); *F15B 21/14* (2013.01); *F15B 2201/51* (2013.01)

(58) Field of Classification Search
CPC ..... F15B 21/14; F15B 1/08; F15B 2201/50; E02F 9/2217
See application file for complete search history.

(56) References Cited

U.S. PATENT DOCUMENTS

2013/0247999 A1 9/2013 Chen et al.
2014/0060030 A1 3/2014 Ma et al.

FOREIGN PATENT DOCUMENTS

JP 61-123201 U 8/1986
JP 5-26201 A 2/1993
(Continued)

OTHER PUBLICATIONS

International Search Report (PCT/ISA/210) issued in PCT Application No. PCT/JP2018/019335 dated Jul. 17, 2018 with English translation (three (3) pages).
(Continued)

*Primary Examiner* — Abiy Teka
(74) *Attorney, Agent, or Firm* — Crowell & Moring LLP

(57) ABSTRACT

A controller (45) is provided with an elapse time measuring section (47A) that measures an elapse time (tx) elapsed since an initial use of an accumulator (29) based upon a reset signal from a reset switch (44), a number-of-operations measuring section (47B) that measures a number of operations of the accumulator (29), that is, a number (N) of boom lowering operations after a reset, based upon a detection signal from an accumulator side pressure sensor (39), a gas permeation amount estimating section (47C) that estimates an estimation gas permeation amount (Qloss) of the accumulator (29), a sealed gas pressure estimating section (47D) that finds an estimation sealed gas pressure (Pgs) of a gas
(Continued)

chamber (29B) of the accumulator (29), and an accumulator degradation determining section (47E) that determines a degradation condition of the accumulator (29) and outputs the determination result.

4 Claims, 10 Drawing Sheets

(56) References Cited

FOREIGN PATENT DOCUMENTS

| | | | | | |
|---|---|---|---|---|---|
| JP | 05026201 | A | * | 2/1993 | ..... F15B 19/00 |
| JP | 2002-120096 | A | | 4/2002 | |
| JP | 2004-162846 | A | | 6/2004 | |
| JP | 2005-3183 | A | | 1/2005 | |
| JP | 2009-19678 | A | | 1/2009 | |
| JP | 2009-264456 | A | | 11/2009 | |
| JP | 2011-6919 | A | | 1/2011 | |
| JP | 2011006919 | A | * | 1/2011 | |

OTHER PUBLICATIONS

Japanese-language Written Opinion (PCT/ISA/237) issued in PCT/JP2018/019335 dated Jul. 17, 2018 (three (3) pages).

Korean-language Office Action issued in Korean Application No. 10-2019-7025572 dated Nov. 2, 2020 with English translation (10 pages).

Supplementary European Search Report issued in European Application No. 18854003.3 dated Nov. 16, 2020 (7 pages).

Japanese-language Office Action issued in Japanese Application No. 2017-174066 dated Sep. 15, 2020 with English translation (six (6) pages).

Korean-language Office Action issued in Korean Application No. 10-2019-7025572 dated May 27, 2021 with English translation (12 pages).

* cited by examiner

HYDRAULIC ENERGY RECOVERY APPARATUS FOR WORKING MACHINE

TECHNICAL FIELD

The present invention relates to a hydraulic energy recovery apparatus for a working machine to be used for recovering energy of pressurized oil from a hydraulic actuator of a hydraulic excavator, for example.

BACKGROUND ART

In recent years, a working machine represented by a hydraulic excavator has been developed, which is provided with an accumulator on a hydraulic circuit for the purpose of a load reduction of a hydraulic pump or efficient reuse of hydraulic energy (Patent Documents 1, 2). Among them, a conventional technology of Patent Document 1 has the configuration that a branch oil path is provided in a main pipe for connection between a hydraulic actuator and a directional control valve to be connected to the accumulator. This accumulator accumulates high-pressure oil returning from the hydraulic actuator to a tank. At the full operation time of an operation lever, the pressurized oil in the accumulator is released to assist in an operation of the hydraulic actuator. Thereby, the load of the hydraulic pump can be reduced to suppress a fuel consumption amount of an engine.

PRIOR ART DOCUMENT

Patent Document

Patent Document 1: Japanese Patent Laid-Open No. 2005-003183 A

Patent Document 2: Japanese Patent Laid-Open No. 2009-19678 A

SUMMARY OF THE INVENTION

Incidentally, in the hydraulic energy recovery apparatus according to the conventional technology, when the accumulator is broken or is remarkably lowered in performance, a fuel consumption amount suppression effect to be expected cannot be obtained. Further, a pressurized gas sealed in a gas chamber of the accumulator is possibly leaked out to a hydraulic pipe arrangement. Caused by this, hydraulic oil is possibly spurted to an exterior from a hydraulic oil tank. Therefore, in Patent Document 2, in a case where the pressurized gas in the accumulator is leaked to the hydraulic pipe arrangement, for preventing the hydraulic oil in the pipe arrangement from spurting to an exterior from the hydraulic oil tank, an inner pressure of the hydraulic oil tank is displayed on a monitor screen to enable the damage of the accumulator to be easily detected.

However, the broken form of the accumulator is not limited to the embodiment in which a diaphragm of the accumulator is broken and the accumulated gas is abruptly released to the oil chamber, as described in Patent Document 2. For example, in a case of a piston type accumulator, a gas gradually permeates from a seal ring between a piston outer peripheral surface and a cylinder inner peripheral surface. In addition, in a case of a bladder type accumulator, a gas gradually permeates from a bladder. Thereby, the sealed gas pressure in the accumulator gradually reduces, and in some cases, a so-called performance degradation occurs.

In a case of such performance degradation, since the gas in the gas chamber gradually leaks to the oil chamber, an inner pressure increasing rate of the hydraulic oil tank does not change remarkably. As a result, for example, as described in Patent Document 1, it is difficult to detect the performance degradation of the accumulator by a pressure detector provided in the hydraulic oil tank. Further, even in a case where abnormality is detected after the accumulator is actually broken, the working machine such as a hydraulic excavator cannot work due to the break of the accumulator, thereby damaging the convenience.

The present invention is made in view of the foregoing problems in the conventional technology, and an object of the present invention is to provide a hydraulic energy recovery apparatus for a working machine that can early detect or predict a degradation state of an accumulator to prompt an operator to take an appropriate measure.

For solving the aforementioned problems, the present invention is applied to a hydraulic energy recovery apparatus for a working machine provided with a main pump that is driven by a prime mover mounted on a working machine; a hydraulic actuator that is driven by the main pump; and an accumulator that recovers a part or all of returned oil from the hydraulic actuator.

The feature of the configuration that is adopted by the present invention includes a pressure detector that detects a pressure of the accumulator; a reset device that is reset at the time of the replacement of the accumulator; and a controller to which signals from an operation lever device configured to operate the hydraulic actuator, the pressure detector and the reset device are input, wherein the controller includes: an elapse time measuring section that measures time elapsed since an initial use of the accumulator based upon the signal from the reset device; a number-of-operations measuring section that measures a number of operations of the accumulator based upon the signal from the pressure detector; a sealed gas pressure estimating section that estimates a sealed gas pressure of the accumulator from a rising state of an accumulator pressure in a case of starting accumulation from a state where the accumulator pressure is equal to a tank pressure, based upon the signal from the pressure detector; and an accumulator degradation determining section that determines a degradation condition of the accumulator based upon at least one output of outputs from the elapse time measuring section, the number-of-operations measuring section and the sealed gas pressure estimating section, and outputs the determination result.

As described above, according to the present invention, the degradation condition of the accumulator is determined based upon the elapse time elapsed or the number of operations since the initial use of the accumulator, or the estimation value of the sealed gas pressure. Thereby, it is possible to notify an operator of the result of the degradation determination before actually broken or prompt the operator for the replacement of the accumulator as needed, thus improving convenience and reliability as the hydraulic energy recovery apparatus.

MODE FOR CARRYING OUT THE INVENTION

Hereinafter, an explanation will be in detail made of a hydraulic energy recovery apparatus for a working machine according to an embodiment of the present invention by taking a case of being applied to a hydraulic cylinder drive circuit to be mounted on a hydraulic excavator as an example with reference to FIG. 1 to FIG. 10 in the accompanying drawings.

Figure 1:
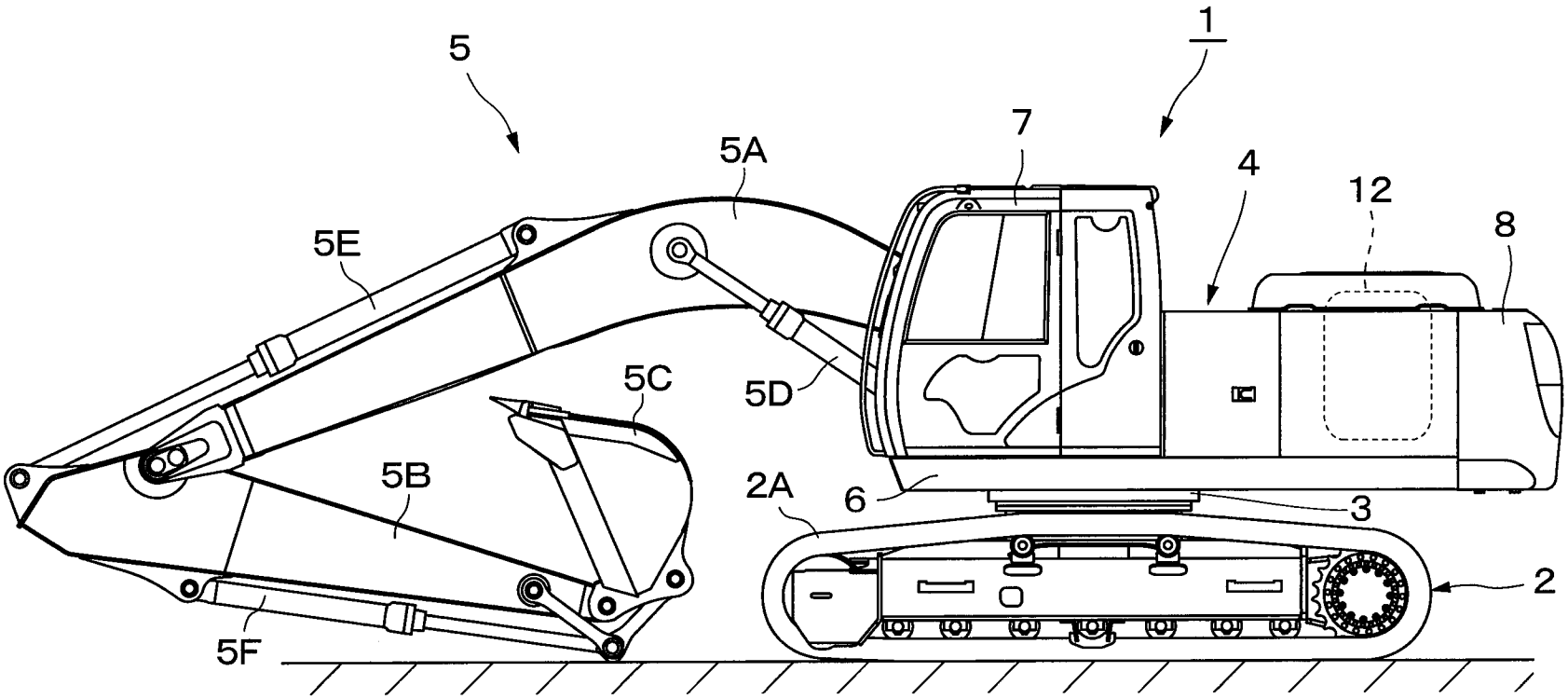
FIG. 1 is an appearance diagram showing a hydraulic excavator on which a hydraulic energy recovery apparatus according to an embodiment of the present invention is mounted.

In FIG. 1, a hydraulic excavator 1, which is a representative example of a working machine, is configured to include an automotive lower traveling structure 2 of a crawler type, a revolving device 3 mounted on the lower traveling structure 2, an upper revolving structure 4 rotatably mounted on the lower traveling structure 2 via the revolving device 3, and a working mechanism 5 with a multi-joint structure which is provided in the front side of the upper revolving structure 4 to perform an excavating work and the like. In this case, the lower traveling structure 2 and the upper revolving structure 4 form part of a vehicle body of the hydraulic excavator 1.

The lower traveling structure 2 is configured to include, a pair of left and right crawler belts 2A (only one side is shown), and left and right traveling hydraulic motors (not shown) that drive the rotation of the respective crawler belts 2A to cause the hydraulic excavator 1 to travel. The lower traveling structure 2 causes the hydraulic excavator 1 to travel forward or backward by rotation and drive of the traveling hydraulic motors, based on a delivery of pressurized oil from a main hydraulic pump 13 to be described later (see FIG. 2).

The working mechanism 5, which is also called a working machine or a front, is configured to include, for example, a boom 5A, an arm 5B and a bucket 5C as a working tool, as well as a boom cylinder 5D, an arm cylinder 5E and a bucket cylinder (a working tool cylinder) 5F which serve as hydraulic actuators driving the boom 5A, the arm 5B and the bucket 5C. Hydraulic cylinders (the cylinders 5D, 5E, 5F) extend or contract based on delivery and suction of pressurized oil from the main hydraulic pump 13 (that is, a main pump) shown in FIG. 2, thereby causing the working mechanism 5 to be operated to tilt up or down (swing up or down).

It should be noted that a circuit diagram in FIG. 2 to be hereinafter explained shows a hydraulic cylinder drive circuit for driving and controlling mainly the boom cylinder 5D (a representative example of the hydraulic cylinders). This is merely because the figure is prevented from being complicated and is simplified to clarify the explanation. Drive circuits (not shown) as well in association with the arm cylinder 5E, the bucket cylinder 5F, the above-described left and right traveling hydraulic motors and a later-described revolving hydraulic motor are configured as almost similar to those in FIG. 2.

The upper revolving structure 4 is mounted on the lower traveling structure 2 via the revolving device 3 which is configured to include a revolving bearing, the revolving hydraulic motor, a reduction mechanism and the like. The upper revolving structure 4 revolves together with the working mechanism 5 on the lower traveling structure 2 by rotation and drive of the revolving hydraulic motor which is a hydraulic motor, based on a delivery of the pressurized oil from the later-described main hydraulic pump 13 (see FIG. 2). The upper revolving structure 4 is configured to include a revolving frame 6 which is a support structure (a base frame) of the upper revolving structure 4, a cab 7 mounted on the revolving frame 6, a counterweight 8 and the like.

Figure 2:
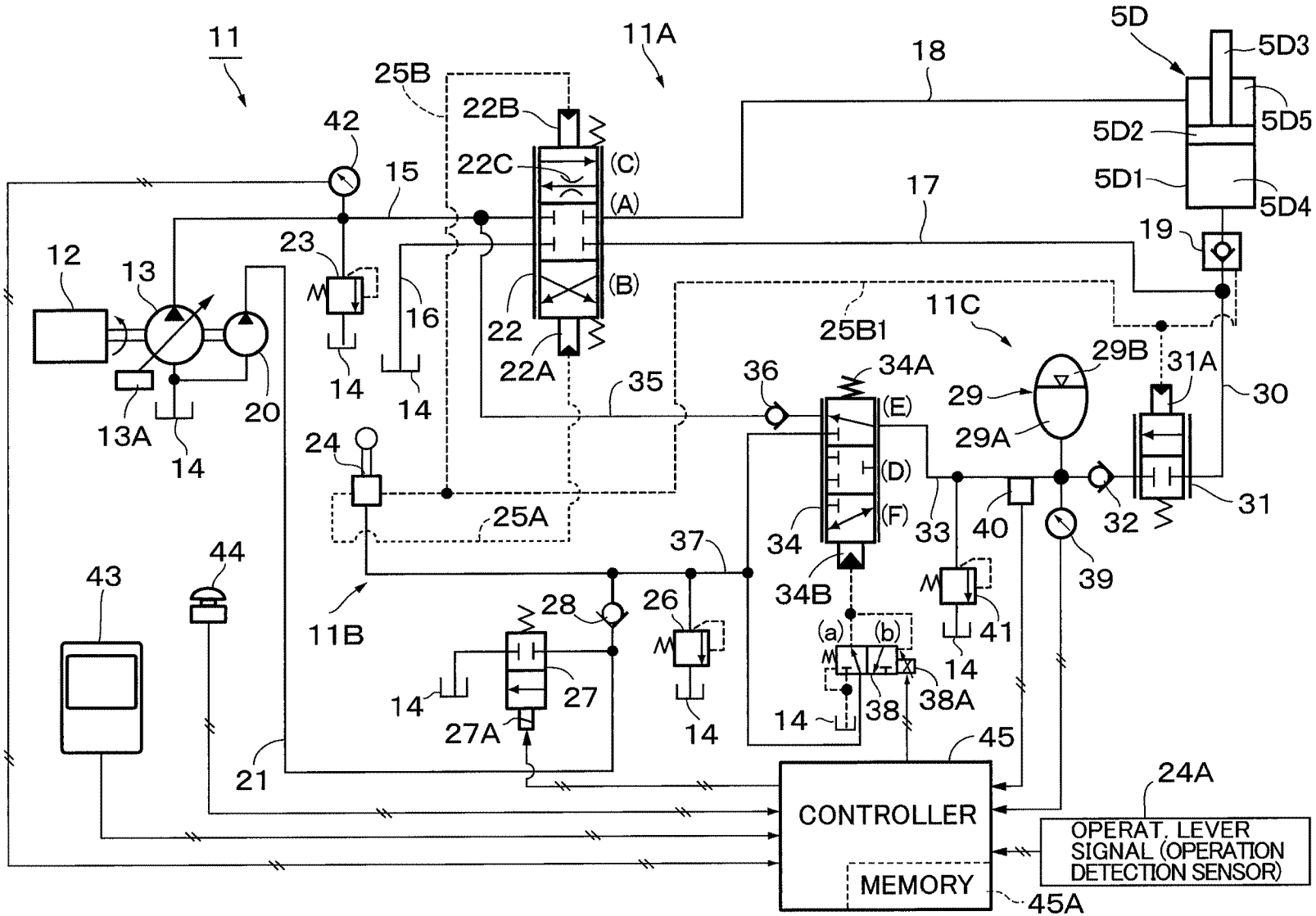
FIG. 2 is a control circuit diagram showing a hydraulic cylinder drive circuit, to which the hydraulic energy recovery apparatus according to the embodiment is applied, in a stop state of an engine.

In this case, the revolving frame 6 is provided with a later-described engine 12, the main hydraulic pump 13 and a pilot hydraulic pump 20, a hydraulic oil tank 14, a control valve device (only a boom directional control valve 22 is shown in FIG. 2), and the like, which are mounted thereon. A later-described controller 45 (refer to FIG. 2 to FIG. 6) is provided in the cab 7 to be positioned in a backward lower side of an operator's seat, for example. On the other hand, the counterweight 8 for acting as a weight balance to the working mechanism 5 is provided in the rear end side of the revolving frame 6 to be positioned in back of the engine 12, for example.

The revolving frame 6 is mounted on the lower traveling structure 2 via the revolving device 3. The cab 7 having the interior serving as an operator's room is provided on a front part left side of the revolving frame 6. The operator's seat (not shown) on which an operator sits is mounted in the cab 7. Various kinds of operating devices for operating the hydraulic excavator 1 (only a boom operation lever device 24 is shown in FIG. 2) are provided around the operator's seat. The operating devices are configured to include, for example, left and right traveling lever pedal operating devices which are provided in front of the operator's seat, and left and right working operation lever devices which are provided respectively on both sides in the left and right of the operator's seat.

The hydraulic circuit diagram of FIG. 2 shows only the boom operation lever device 24 for driving and operating the boom 5A of the working mechanism 5, that is, the boom cylinder 5D, of the various operating devices (the traveling operating device and the working operating device). For example, the traveling lever pedal operating devices, the revolving lever operating device, the arm lever operating device, the bucket lever operating device and the like are omitted in illustration. The boom operation lever device 24 is operable in response to the operation in the front-rear direction of the working operation lever device on the right side, for example.

The operating device outputs a pilot signal (a pilot pressure) in response to the operator's operation (a lever operation or a pedal operation) to a control valve device configured of a plurality of directional control valves (only the boom directional control valve 22 is shown in FIG. 2). Thereby, the operator can operate (drive) the traveling hydraulic motor, the cylinders 5D, 5E, 5F of the working mechanism 5 and the revolving hydraulic motor of the revolving device 3. It should be noted that only the boom directional control valve 22 of the plurality of directional control valves configuring the control valve device is shown in the hydraulic circuit diagram of FIG. 2 (for example, a left traveling directional control valve, a right traveling directional control valve, a revolving directional control valve, an arm directional control valve, a bucket directional control valve and the like are omitted).

Next, an explanation will be made of a hydraulic cylinder drive circuit (that is, a hydraulic cylinder drive device) for driving a hydraulic actuator (for example, the boom cylinder 5D for operating the boom 5A) of the hydraulic excavator 1 with reference to FIG. 2 to FIG. 5.

As shown in FIG. 2 to FIG. 5, the hydraulic excavator 1 is provided with a hydraulic circuit 11 to cause the hydraulic actuator of the hydraulic excavator 1 to operate (drive) based on the pressurized oil delivered from the hydraulic pump 13 as a main pump. The hydraulic circuit 11 is configured to include a main hydraulic circuit 11A including a hydraulic actuator (for example, the boom cylinder 5D), a pilot hydraulic circuit 11B for operating a hydraulic actuator (for example, the boom cylinder 5D), and a recovery hydraulic circuit 11C including the later-described accumulator 29.

That is, the hydraulic circuit 11 is configured to include, for example, the boom cylinder 5D, the engine 12, the hydraulic pump 13, the hydraulic oil tank 14 as a tank, the pilot hydraulic pump 20, the control valve device (for example, the boom directional control valve 22), and the operating device (for example, the boom operation lever device 24). In addition to this, the hydraulic circuit 11 is configured to include the accumulator 29, a recovery device and a recovery control valve 31 serving as a first control valve, a supply and discharge control valve 34 serving as a second control valve acting as both of a main circuit supply device and a pilot circuit supply and discharge device, an accumulator side pressure sensor 39 serving as a first pressure detector, and the controller 45 serving as a control device.

The main hydraulic circuit 11A of the hydraulic circuit 11 is provided with, for example, in addition to the boom cylinder 5D, the engine 12, the hydraulic pump 13, the hydraulic oil tank 14, the boom directional control valve 22, a pilot check valve 19 and a high-pressure relief valve 23. In addition, the main hydraulic circuit 11A is provided with a main delivery line 15, a return line 16, a bottom side line 17 and a rod side line 18.

On the other hand, the pilot hydraulic circuit 11B of the hydraulic circuit 11 is provided with the engine 12, the pilot hydraulic pump 20, the hydraulic oil tank 14, a pilot delivery line 21, the operating device (for example, the boom operation lever device 24), a low-pressure relief valve 26, an extending-side pilot line 25A serving as an one-side pilot line, and a contracting-side pilot line 25B serving as an other-side pilot line. In addition, the pilot hydraulic circuit 11B is also provided with an unloader valve 27 serving as a pilot flow rate reducing device and a check valve 28 serving as a non-return valve.

Further, the recovery hydraulic circuit 11C of the hydraulic circuit 11 forms a hydraulic energy recovery apparatus, and is provided with, in addition to the accumulator 29, the recovery control valve 31, the supply and discharge control valve 34, the accumulator side pressure sensor 39, and the controller 45. In addition, the recovery hydraulic circuit 11C is also provided with a recovery line 30, a recovery check valve 32, a main regeneration line 35 and a pilot regeneration line 37.

It should be noted that the hydraulic circuit 11 shown in FIG. 2 mainly shows a boom hydraulic drive circuit (that is, a boom hydraulic drive device) for driving the boom cylinder 5D in an extending or contracting direction. In other words, the hydraulic circuit 11 shown in FIG. 2 omits in illustration a traveling hydraulic circuit (that is, a traveling hydraulic drive device) for causing the lower traveling structure 2 to travel, an arm hydraulic circuit (that is, an arm hydraulic drive device) for driving the arm 5B in an extending or contracting direction, a bucket hydraulic circuit (that is, a bucket hydraulic drive device) for driving the bucket 5C in an extending or contracting direction, and a revolving hydraulic circuit (that is, a revolving hydraulic drive device) for driving the revolving device 3 (revolving the upper revolving structure 4 relative to the lower traveling structure 2).

The engine 12 as a prime mover is mounted on the revolving frame 6. The engine 12 is configured of, for example, an internal combustion engine such as a diesel engine or the like. The main hydraulic pump 13 and the pilot hydraulic pump 20 are mounted to the output side of the engine 12, and the main hydraulic pump 13 and the pilot hydraulic pump 20 are driven and rotated by the engine 12. It should be noted that a drive source (the prime mover) for driving the main hydraulic pump 13 and the pilot hydraulic pump 20 may be configured of the engine 12 alone which serves as an internal combustion engine, or alternatively, may be configured of, for example, a combination of an engine and an electric motor or an electric motor alone.

The main hydraulic pump 13 is connected mechanically to the engine 12 (that is, in such a manner that power can be transferred). The main hydraulic pump 13 delivers pressurized oil to the main hydraulic circuit 11A including the hydraulic actuator (the boom cylinder 5D). The main hydraulic pump 13 is configured of, for example, a variable displacement hydraulic pump, more specifically, a variable displacement swash-plate type, a variable displacement bent-axis type or a variable displacement radial-piston type hydraulic pump. It should be noted that FIG. 2 shows the main hydraulic pump 13 serving as a single hydraulic pump, but the main hydraulic pump 13 may be configured of two or more hydraulic pumps, for example.

The main hydraulic pump 13 is connected to the hydraulic actuator via the control valve device. For example, the main hydraulic pump 13 is connected to the boom cylinder 5D via the boom directional control valve 22, and delivers pressurized oil to the boom cylinder 5D. It should be noted that the main hydraulic pump 13 also delivers the pressurized oil to, for example, the arm cylinder 5E, the bucket cylinder 5F, the traveling hydraulic motor, and the revolving hydraulic motor other than the boom cylinder 5D (none of them is shown).

The main hydraulic pump 13 delivers the hydraulic oil reserved in the hydraulic oil tank 14 to the main delivery line 15, as pressurized oil. The pressurized oil delivered to the main delivery line 15 is supplied via the boom directional control valve 22 to a bottom side oil chamber 5D4 or a rod side oil chamber 5D5 of the boom cylinder 5D via the boom directional control valve 22. The pressurized oil in the rod side oil chamber 5D5 or the bottom side oil chamber 5D4 of the boom cylinder 5D returns via the boom directional control valve 22 and the return line 16 to the hydraulic oil tank 14. In this way, the main hydraulic pump 13 forms a main hydraulic source together with the hydraulic oil tank 14 for reserving the hydraulic oil.

As shown in FIG. 2, the boom cylinder 5D is configured to include a tube 5D1 that defines an outer shell, a piston 5D2 and a rod 5D3. The piston 5D2 is slidably inserted and fitted into the tube 5D1, and the tube 5D1 is defined into the bottom side oil chamber 5D4 and the rod side oil chamber 5D5. The rod 5D3 has a base end side secured to the piston 5D2 and a front end side protruding out of the tube 5D1. The bottom side line 17 is served for connection between the boom directional control valve 22 and the bottom side oil chamber 5D4, and the rod side line 18 is served for connection between the boom directional control valve 22 and the rod side oil chamber 5D5.

In this case, the later-described recovery line 30 is connected to the course of the bottom side line 17. In addition, the pilot check valve 19 is provided on the bottom side line 17 to be located between the bottom side oil chamber 5D4 of the hydraulic cylinder 5D and a connecting part (a branch part) between the bottom side line 17 and the recovery line 30. The pilot check valve 19, as similar to a regular check valve, allows the flow of pressurized oil from the bottom side line 17-side toward the bottom side oil chamber 5D4, and blocks the flow of pressurized oil in a direction in reverse thereto (from the bottom side oil chamber 5D4 toward the bottom side line 17-side).

However, a pilot pressure (a secondary pressure) in response to an operation of the boom operation lever device 24 is supplied to the pilot check valve 19 via a later-described branch pilot line 25B1. In a case where the pilot pressure from the branch pilot line 25B1 is being supplied to the pilot check valve 19 (that is, in a case where the boom operation lever device 24 is operated in a direction of contracting the boom cylinder 5D), the pilot check valve 19 is forcibly opened by the pilot pressure. When the pilot check valve 19 is opened, the pressurized oil in the bottom side oil chamber 5D4 flows (is discharged) toward the bottom side line 17 and the recovery line 30-side.

As similar to the main hydraulic pump 13, the pilot hydraulic pump 20 is driven and rotated by the engine 12. Thereby, the pilot hydraulic pump 20 delivers pilot pressurized oil to the pilot hydraulic circuit 11B for operating the hydraulic actuator (for example, the boom cylinder 5D). The pilot hydraulic pump 20 is configured of, for example, a fixed displacement gear pump, or a bent-axis type or a swash-plate type hydraulic pump or the like. The pilot hydraulic pump 20 delivers the hydraulic oil reserved in the hydraulic oil tank 14 to the pilot delivery line 21 as the pressurized oil. That is, the pilot hydraulic pump 20 forms a pilot hydraulic source together with the hydraulic oil tank 14.

The pilot hydraulic pump 20 is connected to the operating device (the boom operation lever device 24) via the pilot delivery line 21 and the like. The pilot hydraulic pump 20 delivers the pilot pressurized oil as a primary pressure to the operating device (the boom operation lever device 24). In this case, the pilot pressurized oil delivered from the pilot hydraulic pump 20 is delivered via the operating device (the boom operation lever device 24) to the control valve device (pilot parts 22A, 22B of the boom directional control valve 22), the pilot check valve 19 and the later-described recovery control valve 31.

The control valve device is a control valve group configured of a plurality of directional control valves including the boom directional control valve 22. The control valve device distributes the pressurized oil delivered from the main hydraulic pump 13 to the boom cylinder 5D, the arm cylinder 5E, the bucket cylinder 5F, the traveling hydraulic motor and the revolving hydraulic motor in response to operations of various operating devices including the boom operation lever device 24.

It should be noted that the following description will be given using the boom directional control valve 22 (hereinafter, referred to simply as the "directional control valve 22") as a representative example of the control valve device. In addition, as to the operating device for performing a switching operation of the control valve device, the following description will be also given using the bottom operation lever device 24 (hereinafter, referred to as simply as the "operation lever device 24") for performing a switching operation of the boom directional control valve 22 as a representative example. In addition, also as to the hydraulic actuator operated (extended or contracted) by an operation of the operating device, the following description will be given using the boom cylinder 5D (hereinafter, referred to simply as the "hydraulic cylinder 5D" as well) as a representative example.

The directional control valve 22 controls the direction of the pressurized oil delivered from the main hydraulic pump 13 to the hydraulic cylinder 5D in response to a switching signal (a pilot pressure) caused by the operation of the operation lever device 24 located within the cab 7. Thereby, the hydraulic cylinder 5D is driven in the extending or contracting direction by the pressurized oil suppled (delivered) from the main hydraulic pump 13. The directional control valve 22 is configured of a pilot-operated directional control valve, for example, a directional control valve composed of a hydraulic pilot servo valve of a 4-port and a 3-position (or a 6-port and a 3-position).

The directional control valve 22 switches delivery and discharge of the pressurized oil to and from the hydraulic cylinder 5D between the main hydraulic pump 13 and the hydraulic cylinder 5D. Thereby, the hydraulic cylinder 5D is extended or contracted. A switching signal (a pilot pressure) based on the operation of the operation lever device 24 is supplied to the hydraulic pilot parts 22A, 22B of the directional control valve 22. Thereby, the directional control valve 22 is switched from a neutral position (A) to any of switch positions (B) and (C).

The high-pressure relief valve 23 is provided in the course of the main delivery line 15 to be located between the main hydraulic pump 13 and the directional control valve 22. The high-pressure relief valve 23, for preventing an excessive load from being applied to the main hydraulic pump 13, is opened when the pressure in the main delivery line 15 exceeds a predetermined pressure (a high-pressure set value), to relieve an excessive pressure toward the hydraulic oil tank 14-side. The pressure in the main delivery line 15 is detected by a later-described pump-side pressure sensor 42.

The operation lever device 24 is located within the cab 7 of the upper revolving structure 4. The operation lever device 24 is configured of a lever style, pressure reducing valve type pilot valve, for example. The pressurized oil (the primary pressure) is delivered from the pilot hydraulic pump 20 via the pilot delivery line 21 to the operation lever device 24. The operation lever device 24 outputs a pilot pressure (a secondary pressure) in response to the lever operation of the operator, to hydraulic pilot parts 22A, 22B of the directional control valve 22 via the extending-side pilot line 25A or the contracting-side pilot line 25B.

Figure 5:
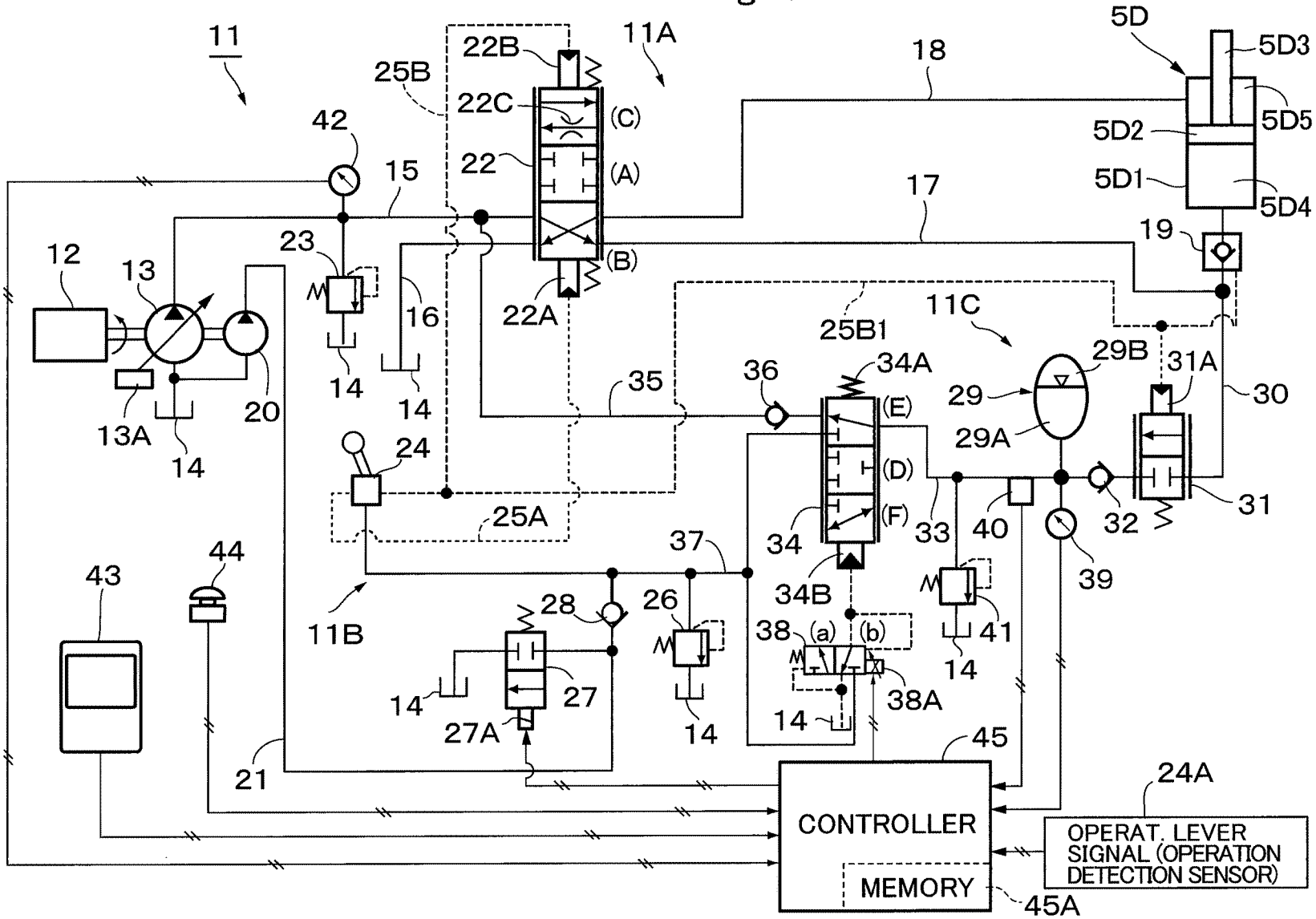
FIG. 5 is a control circuit diagram showing a state where pressurized oil recovered and accumulated in the accumulator is regenerated in a main circuit side.

That is, when the operation lever device 24 is operated to be tilted by the operator, a pilot pressure in proportion to the operation amount is supplied to any of the pressure pilot parts 22A, 22B of the directional control valve 22. For example, as shown in FIG. 5, when the operation lever device 24 is operated in a direction of extending the boom cylinder 5D (that is, when the raising operation to tilt up the boom 5A is performed), a pilot pressure produced by the operation is supplied to the hydraulic pilot part 22A of the directional control valve 22 via the extending-side pilot line 25A. This causes the directional control valve 22 to switch from the neutral position (A) to the switch position (B) in the boom raising side. Therefore, the pressurized oil from the main hydraulic pump 13 is delivered to the bottom side oil chamber 5D4 of the hydraulic cylinder 5D via the bottom side line 17. The pressurized oil in the rod side oil chamber 5D5 of the hydraulic cylinder 5D is returned to the hydraulic oil tank 14 via the rod side line 18 and the return line 16.

Figure 4:
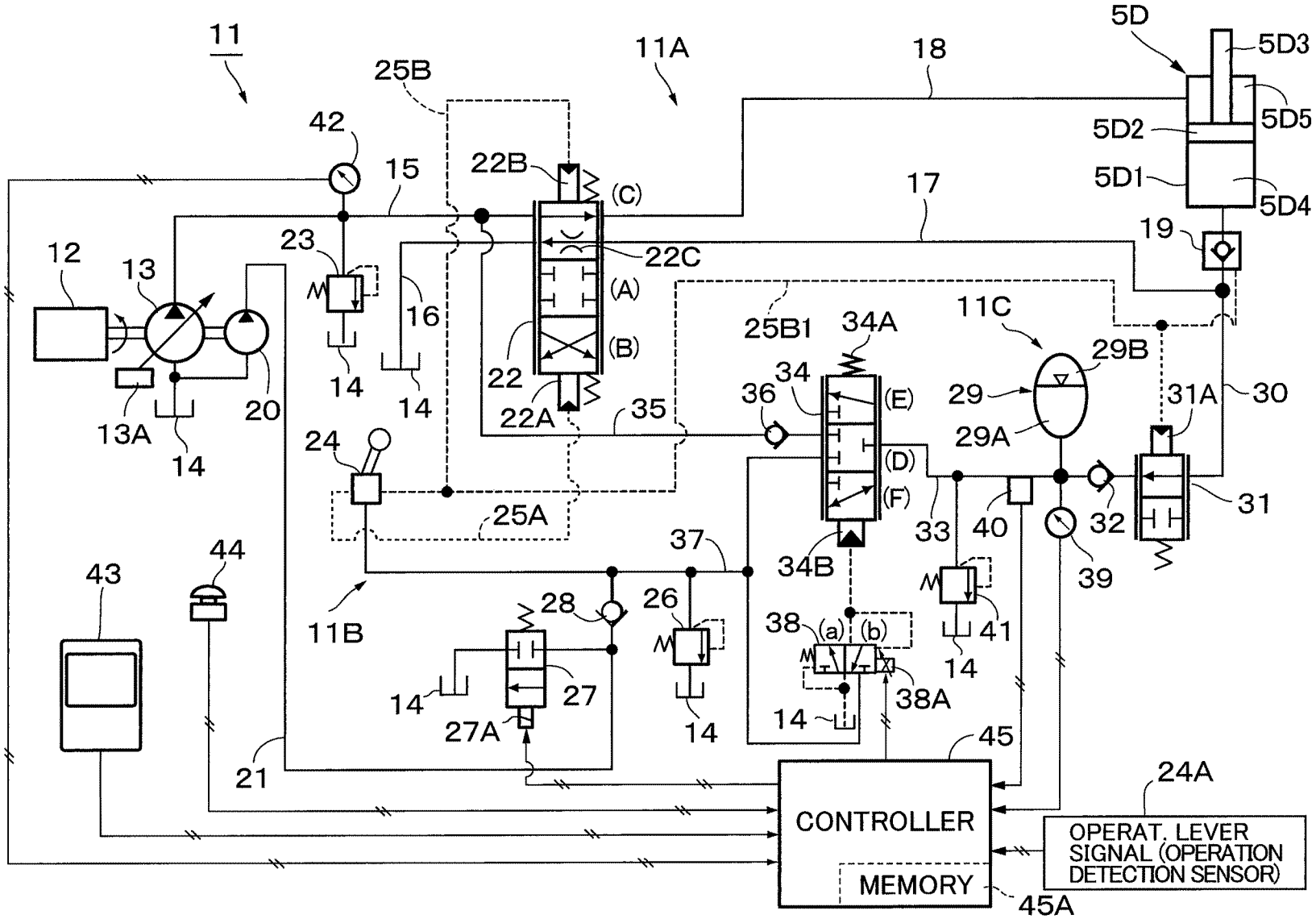
FIG. 4 is a control circuit diagram showing a state where a directional control valve in FIG. 3 is switched to a position of a boom lowering operation to cause an accumulator to recover pressurized oil.

On the contrary, for example, as shown in FIG. 4, when the operation lever device 24 is operated in a direction of contracting the boom cylinder 5D (that is, when the lowering operation to tilt down the boom 5A is performed), a pilot pressure produced by the operation is supplied to the hydraulic pilot part 22B of the directional control valve 22 via the contracting-side pilot line 25B. This causes the directional control valve 22 to switch from the neutral position (A) to the switch position (C) in the boom lowering side. Therefore, the pressurized oil from the main hydraulic pump 13 is delivered to the rod side oil chamber 5D5 of the hydraulic cylinder 5D via the rod side line 18.

The pilot pressure at this time is delivered also to the pilot check valve 19 via a branch pilot line 25B1 which branches off from the contracting-side pilot line 25B. Therefore, the pilot check valve 19 is forcibly opened by the pilot pressure from the branch pilot line 25B1. Thereby, the pressurized oil can flow from the bottom side oil chamber 5D4 of the hydraulic cylinder 5D toward the bottom side line 17. That is, the pilot check valve 19 blocks the circuit under normal conditions to prevent an accidental outflow of the pressurized oil from the bottom side oil chamber 5D4 of the hydraulic cylinder 5D (the boom falling-down). However, at the time of tilting down (lowering) the boom 5A, the circuit is opened by the pilot check valve 19.

In addition, the pilot pressure from the branch pilot line 25B1 is delivered also to a hydraulic pilot part 31A of the later-described recovery control valve 31. When the pilot pressure is delivered to the recovery control valve 31, the recovery control valve 31 is switched from a closed position to an open position to cause the bottom side oil chamber 5D4 in the hydraulic cylinder 5D to be communicated with the accumulator 29. Thereby, the pressurized oil in the bottom side oil chamber 5D4 is supplied to the accumulator 29. That is, the pressurized oil in the bottom side oil chamber 5D4 of the hydraulic cylinder 5D is recovered into the accumulator 29. At this time, the pressurized oil flows from the bottom side oil chamber 5D4 of the hydraulic cylinder 5D via the bottom side line 17 toward the directional control valve 22 (the return line 16)-side. This pressurized oil (that is, the pressurized oil that returns to the hydraulic oil tank 14) is limited in a flow rate by a throttle 22C in the switch position (C) of the directional control valve 22.

The operation lever device 24 is provided with an operation detection sensor 24A as an operation detector that detects a tilting operation of the operator. The operation detection sensor 24A is connected to the controller 45. The operation detection sensor 24A outputs a signal corresponding to the presence or absence of the lever operation or the lever operating amount to the controller 45, as an operation lever signal. The operation detection sensor 24A may be configured of, for example, a displacement sensor or a pressure sensor detecting a pilot pressure. The operation detection sensor 24A is mounted in not only the bottom operation lever device 24 shown in FIG. 2, but also other operating devices (none of them is shown).

The low-pressure relief valve 26 is provided in the course of the pilot delivery line 21. The low-pressure relief valve 26 is located upstream of the later-described check valve 28 and is provided between the pilot delivery line 21 and the hydraulic oil tank 14. The low-pressure relief valve 26 is opened when the pressure in the pilot delivery line 21 exceeds a predetermined pressure (a low-pressure set value Ps0 shown in FIG. 10)) to relieve an excessive pressure toward the hydraulic oil tank 14-side. In addition, the unloader valve 27 and the check valve 28 are provided in the course of the pilot delivery line 21. It should be noted that the later-described pilot regeneration line 37 is connected to a portion of the pilot delivery line 21 between the check valve 28 and the operation lever device 24.

The unloader valve 27 is located between the pilot hydraulic pump 20 and the pilot hydraulic circuit 11B (that is, on the delivery side of the pilot hydraulic pump 20 and upstream of the check valve 28). The unloader valve 27 discharges the pressurized oil delivered from the pilot hydraulic pump 20 to the hydraulic oil tank 14. The unloader valve 27 is configured of, for example, a solenoid pilot switching valve (a solenoid switching valve or a solenoid control valve) of a 2-port and a 2-position. A solenoid pilot part 27A of the unloader valve 27 is connected to the controller 45.

The unloader valve 27 is regularly in the closed position, for example, and switches from the closed position to the open position in response to a signal (an instruction) from the controller 45. When the unloader valve 27 is switched to the open position, the pilot delivery line 21 becomes to a state of being communicated with the hydraulic oil tank 14. That is, in response to an instruction (supply of power) from the controller 45, the unloader valve 27 discharges the pressurized oil delivered from the pilot hydraulic pump 20 to the hydraulic oil tank 14. Thereby, the unloader valve 27 forms a pilot flow rate reducing device capable of reducing the rate of flow of the pilot hydraulic oil flowing from the pilot hydraulic pump 20 to the pilot hydraulic circuit 11B (more specifically, to the operation lever device 24-side).

The check valve 28 is provided between the unloader valve 27 and the pilot hydraulic circuit 11B (that is, downstream of the unloader valve 27 and upstream of the connecting portion between the pilot regeneration line 37 and the pilot delivery line 21). The check valve 28 is a non-return valve to block the pressurized oil of the pilot hydraulic circuit 11B-side (more specifically, the operation lever device 24-side) from flowing into the unloader valve 27-side. The check valve 28 allows the flow of pressurized oil from the pilot hydraulic pump 20-side toward the operation lever device 24-side and the pilot regeneration line 37-side, and blocks the flow of pressurized oil to the reverse side (from the operation lever device 24-side and the pilot regeneration line 37-side toward the unloader valve 27-side and the pilot hydraulic pump 20-side).

The pilot regeneration line 37 is connected to a portion of the pilot delivery line 21 downstream of the check valve 28. Therefore, the pressurized oil accumulated in the later-described accumulator 29 is supplied to flow from the supply and discharge control valve 34-side into between the check valve 28 and the operation lever device 24 (into a portion of the pilot delivery line 21 downstream of the check valve 28). Accordingly, for example, even when the pressurized oil from the pilot hydraulic pump 20 is being discharged into the hydraulic oil tank 14 by the unloader valve 27, the operation lever device 24 can ensure the pilot pressure by the pressurized oil from the accumulator 29. The check valve 28 blocks the pressurized oil (the pilot pressure from the accumulator 29) at this time from flowing out to the unloader valve 27-side (the hydraulic oil tank 14-side).

The accumulator 29 accumulates the pressurized oil discharged from the hydraulic cylinder 5D. The accumulator 29 is configured of a piston type accumulator or a bladder type accumulator the inside of which is defined into an oil chamber 29A and a gas chamber 29B. The oil chamber 29A of the accumulator 29 is connected to (is communicated with) the recovery line 30 and a hydraulic supply and discharge line 33, and a pressurized gas is sealed in the gas chamber 29B.

As shown in FIG. 4, when the hydraulic cylinder 5D is contracted, the pressurized oil discharged from the bottom side oil chamber 5D4 of the hydraulic cylinder 5D flows into the oil chamber 29A of the accumulator 29 via the pilot check valve 19, the recovery line 30, the recovery control valve 31 and the recovery check valve 32. Thereby, the oil chamber 29A of the accumulator 29 accumulates the pressurized oil in such a manner as to recover a part or all of the returned oil from the hydraulic actuator (the hydraulic cylinder 5D). At this time, the gas chamber 29B is compressed to expand the oil chamber 29A by the accumulated oil amount.

In addition, the accumulator 29, as needed as described later, recovers and accumulates the pressurized oil delivered from the pilot hydraulic pump 20. At this time, the pressurized oil delivered from the pilot hydraulic pump 20 flows into the oil chamber 29A of the accumulator 29 via the pilot regeneration line 37 and the supply and discharge control valve 34 from the pilot delivery line 21-side. The pressurized oil accumulated in the oil chamber 29A of the accumulator 29 is supplied as regeneration oil to the hydraulic cylinder 5D or the operation lever device 24 depending upon which of a main-side position (E) and a pilot-side position (F) the supply and discharge control valve 34 is switched to.

The recovery line 30 is connected at one end to the bottom side line 17 and at the other end to the oil chamber 29A of the accumulator 29. In the course of the recovery line 30, the recovery control valve 31 and the recovery check valve 32 are provided in order from one end (from the bottom side line 17-side). The recovery control valve 31 forms a recovery device to recover the pressurized oil discharged from the hydraulic cylinder 5D, to the accumulator 29. That is, the recovery control valve 31 is a first control valve for connection or block between the bottom side oil chamber 5D4 of the hydraulic cylinder 5D and the accumulator 29. The recovery control valve 31 is configured of, for example, a hydraulic pilot switching valve of a 2-port and a 2-position. A pilot pressure is supplied to the hydraulic pilot part 31A of the recovery control valve 31 via the branch pilot line 25B1 from the operation lever device 24. The recovery control valve 31 is, for example, regularly in the closed position, and switches from the closed position to the open position when the pilot pressure is supplied to the hydraulic pilot part 31A.

That is, in a case where the operation lever device 24 is operated in the direction of contracting the hydraulic cylinder 5D, a pilot pressure in response to the operation of the operation lever device 24 is supplied to the hydraulic pilot part 31A of the recovery control valve 31 via the branch pilot line 25B1 of the contracting-side pilot line 25B. This causes the recovery control valve 31 to switch to the open position to allow communication between the bottom side oil chamber 5D4 of the hydraulic cylinder 5D and the oil chamber 29A of the accumulator 29. At this time, the pressurized oil (the returned oil) discharged from the bottom side oil chamber 5D4 of the hydraulic cylinder 5D is accumulated to be recovered in the oil chamber 29A of the accumulator 29. On the other hand, the recovery control valve 31 is back to the closed position to block the communication between the bottom side oil chamber 5D4 of the hydraulic cylinder 5D and the accumulator 29 (that is, block the recovery line 30 in the course) while the operation lever device 24 is operated in the direction of extending the hydraulic cylinder 5D or is in the neutral state (the non-operating state).

The recovery check valve 32 is located between the recovery control valve 31 and the accumulator 29 and is provided in the course of the recovery line 30. The recovery check valve 32 allows the pressurized oil to flow from the recovery control valve 31-side toward the accumulator 29-side, and blocks the pressurized oil from flowing in the reverse direction (from the accumulator 29-side toward the recovery control valve 31-side). That is, the recovery check valve 32 prevents a back-flow of the pressurized oil from the accumulator 29 toward the bottom side oil chamber 5D4 of the hydraulic cylinder 5D.

The hydraulic supply and discharge line 33 is connected to the oil chamber 29A of the accumulator 29 downstream of the recovery line 30. The hydraulic supply and discharge line 33 is a line for communication between the accumulator 29 and the supply and discharge control valve 34 such that the pressurized oil is supplied and discharged (flows out and flows in) between the oil chamber 29A of the accumulator 29 and the later-described supply and discharge control valve 34. The hydraulic supply and discharge line 33 has a one end part connected to the oil chamber 29A of the accumulator 29 downstream of the recovery line 30 and the other end part connected to the supply and discharge control valve 34.

The supply and discharge control valve 34 is a control valve for switching and connecting the hydraulic supply and discharge line 33 connected to the oil chamber 29A of the accumulator 29 to any of the later-described main regeneration line 35 and the pilot regeneration line 37. The supply and discharge control valve 34 forms a main circuit supply device for supplying the pressurized oil accumulated in the accumulator 29 to the main regeneration line 35 or a pilot circuit supply and discharge device for supplying and discharging the pressurized oil to the accumulator 29 via the pilot regeneration line 37. That is, the supply and discharge control valve 34 is a second control valve for switching connection and block between the oil chamber 29A of the accumulator 29 and the main hydraulic circuit 11A (the main delivery line 15) or the pilot hydraulic circuit 11B (the pilot delivery line 21).

Figure 3:
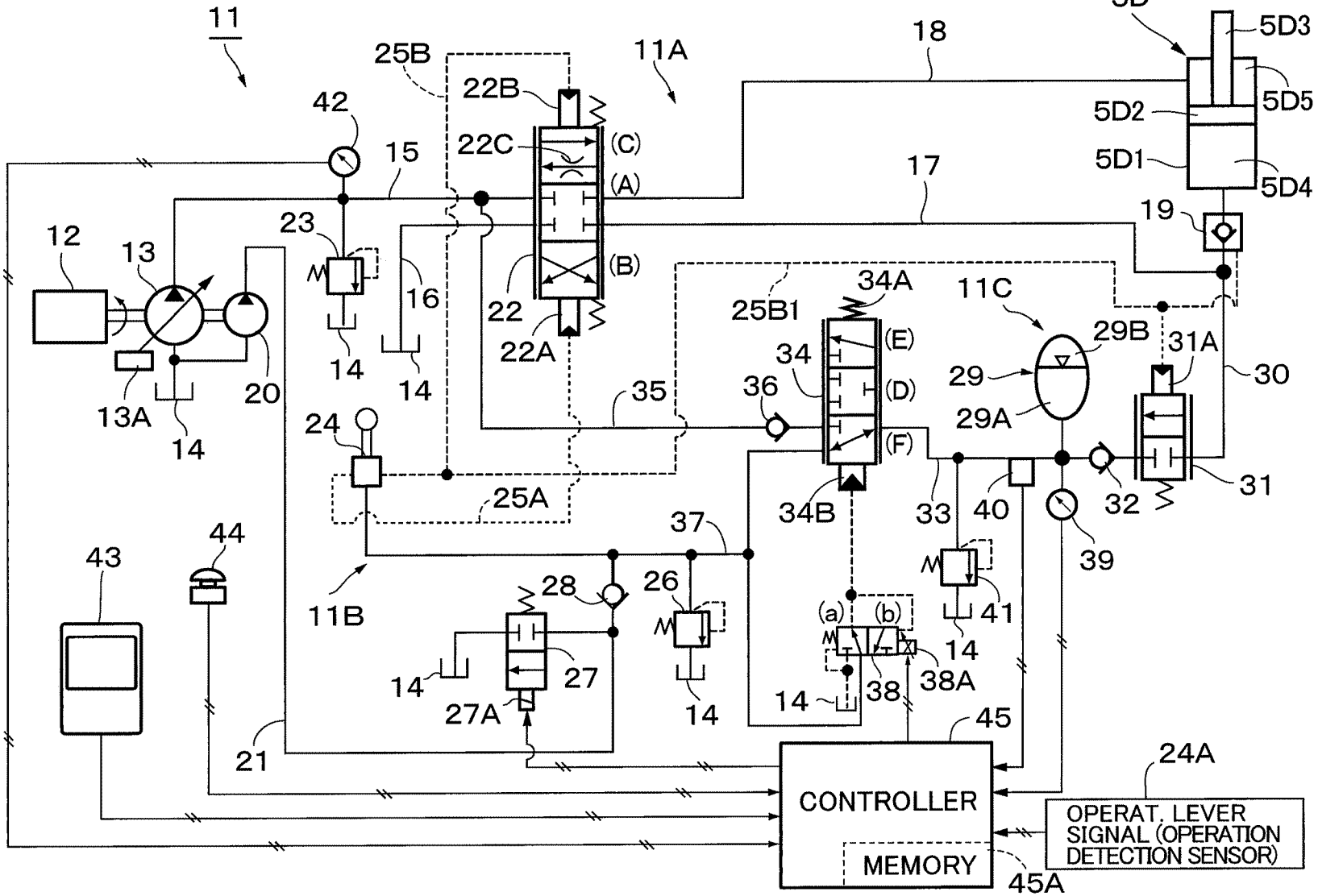
FIG. 3 is a control circuit diagram showing a hydraulic cylinder drive circuit in a state where the engine is working.

The supply and discharge control valve 34 is configured of, for example, a directional control valve composed of a hydraulic pilot servo valve of a 3-port and a 3-position. The supply and discharge control valve 34 is located in the main-side position (E) by a spring 34A while the engine 12 is stopped, as shown in FIG. 2. However, when the engine 12 is worked as shown in FIG. 3 to FIG. 5, the supply and discharge control valve 34 is switched from the main-side position (E) to an intermediate block position (D) or a pilot-side position (F) in accordance with the pilot pressure supplied to a hydraulic pilot part 34B. The pilot pressure is supplied to the hydraulic pilot part 34B of the supply and discharge control valve 34 via a solenoid proportional pressure reducing valve 38 to be switched by the controller 45.

As shown in FIG. 5, while the hydraulic pilot part 34B is communicated with the hydraulic oil tank 14 by switching the solenoid proportional pressure reducing valve 38 to the pressure reducing position (b), the supply and discharge control valve 34 is returned back to the main-side position (E) by the spring 34A. At this time, the oil chamber 29A of the accumulator 29 and the main regeneration line 35 and the main delivery line 15 are connected, and the pressurized oil in the accumulator 29 is merged and supplied to the hydraulic cylinder 5D (for example, to the bottom side oil chamber 5D4) via the directional control valve 22 in the switch position (B), for example.

The main regeneration line 35 is connected to the hydraulic supply and discharge line 33 (that is, to the oil chamber 29A of the accumulator 29) when the supply and discharge control valve 34 is in the main-side position (E), and in this state, the oil chamber 29A of the accumulator 29 is caused to be communicated with the main delivery line 15. The main regeneration line 35 has one end side connected to the supply and discharge control valve 34 and the other end side connected to the main delivery line 15 (that is, between the main hydraulic pump 13 and the directional control valve 22). The main check valve 36 is provided in the course of the main regeneration line 35. The main check valve 36 allows the pressurized oil to flow from the accumulator 29 (the supply and discharge control valve 34)-side toward the main delivery line 15-side, and prevents a back-flow of the pressurized oil. That is, the main check valve 36 prevents the back-flow of the pressurized oil from the main delivery line 15 to the supply and discharge control valve 34 (that is, the accumulator 29)-side.

The pilot regeneration line 37 forms a pilot primary pressure supply path, and is provided to be connected between the supply and discharge control valve 34 and the pilot delivery line 21. That is, the pilot regeneration line 37 has one end part connected to the supply and discharge control valve 34 and the other end part connected to the pilot delivery line 21 (that is, between the check valve 28 and the operation lever device 24). As shown in FIG. 3, the pilot regeneration line 37 is connected to the hydraulic supply and discharge line 33 (that is, to the oil chamber 29A of the accumulator 29) when the supply and discharge control valve 34 is switched to the pilot-side position (F). In this state, the oil chamber 29A of the accumulator 29 is communicated with the pilot delivery line 21 via the hydraulic supply and discharge line 33 and the pilot regeneration line 37. At this time, the pressurized oil accumulated in the accumulator 29 can be supplied to the pilot hydraulic circuit 11B (more specifically, to the pilot delivery line 21) via the pilot regeneration line 37. It should be noted that, in reverse to this, a part of the pilot pressurized oil delivered to the pilot delivery line 21 from the pilot hydraulic pump 20 may be accumulated in the accumulator 29 via the pilot regeneration line 37, the supply and discharge control valve 34 and the hydraulic supply and discharge line 33.

The solenoid proportional pressure reducing valve 38 is a solenoid instruction pressure control valve that is controlled to be switched by the controller 45 and variably reduces and controls a pilot pressure (an instruction pressure) to be supplied to the hydraulic pilot part 34B of the supply and discharge control valve 34. In other words, the solenoid proportional pressure reducing valve 38 is a solenoid valve that reduces a pressure of the pilot regeneration line 37 (the pilot primary pressure supply path) to be introduced to the hydraulic pilot part 34B as a pressure receiving part of the supply and discharge control valve 34. The solenoid proportional pressure reducing valve 38 has a proportional solenoid part (that is, a solenoid proportional pilot part 38A) connected to the output side of the controller 45. The solenoid proportional pressure reducing valve 38 is switched from a communication position (a) to a pressure reducing position (b) in association with a current value of a control signal outputted from the controller 45 to the solenoid proportional pilot part 38A.

When the current value of the control signal is zero, the solenoid proportional pressure reducing valve 38 becomes to the communication position (a) as shown in FIG. 3. Therefore, the solenoid proportional pressure reducing valve 38 supplies the pressure of the pilot pressurized oil supplied from the pilot hydraulic pump 20 via the pilot delivery line 21 and the pilot regeneration line 37 (the pilot primary pressure supply path) to the hydraulic pilot part 34B of the supply and discharge control valve 34 without reducing it. Thereby, the supply and discharge control valve 34 is operated to be switched from the main-side position (E) to the pilot-side position (F) according to the pilot pressure at this time.

As shown in FIG. 4, when the current value of the control signal is increased to be an intermediate value, the solenoid proportional pressure reducing valve 38 is switched in solenoid proportion between the communication position (a) and the pressure reducing position (b). At this time, the solenoid proportional pressure reducing valve 38 controls the pilot pressure (the primary pressure) from the pilot regeneration line 37 for reduction. Thereby, the solenoid proportional pressure reducing valve 38, for example, supplies the pilot pressure reduced to the intermediate pressure to the hydraulic pilot part 34B of the supply and discharge control valve 34. As a result, the supply and discharge control valve 34 is operated to be switched to the intermediate block position (D) according to the pilot pressure of the intermediate pressure.

Further, when the current value of the control signal is increased to be the maximum value, as shown in FIG. 5 the solenoid proportional pressure reducing valve 38 is switched from the communication position (a) to the pressure reducing position (b). Thereby, the hydraulic pilot part 34B of the supply and discharge control valve 34 is communicated with the hydraulic oil tank 14. Therefore, the supply and discharge control valve 34 is returned back to the main-side position (E) by the spring 34A. Thus, the solenoid proportional pressure reducing valve 38 as the solenoid instruction pressure control valve is switched to be in proportion to the current value between the communication position (a) and the pressure reducing position (b) according to the control signal from the controller 45. Thereby, the supply and discharge control valve 34 is controlled to be switched to any of the block position (D), the main-side position (E) and the pilot-side position (F) in accordance with the pilot pressure supplied to the hydraulic pilot part 34B via the solenoid proportional pressure reducing valve 38.

The accumulator side pressure sensor 39 detects a pressure in the oil chamber 29A of the accumulator 29. The accumulator side pressure sensor 39 is provided between the recovery check valve 32 and the accumulator 29 in the recovery line 30 (in other words, between the accumulator 29 and the supply and discharge control valve 34). The accumulator side pressure sensor 39 is a pressure detector that detects a pressure in the oil chamber 29A of the accumulator 29 and outputs the detected signal to the controller 45.

A temperature sensor 40 is a temperature detector provided in a portion (for example, in the course of the hydraulic supply and discharge line 33) communicated with the oil chamber 29A of the accumulator 29. The temperature sensor 40 detects a temperature of the pressurized oil (a hydraulic fluid) flowing in the portion, and outputs the detection signal to the controller 45. A relief valve 41 is positioned between the accumulator 29 and the supply and discharge control valve 34 and is provided in the course of the hydraulic supply and discharge line 33, for example. The relief valve 41 is opened when the pressure in the hydraulic supply and discharge line 33 exceeds a predetermines set pressure for preventing an excessive load from being applied to the accumulator 29 or the supply and discharge control valve 34, and relieves an excessive pressure to the hydraulic oil tank 14-side.

The pump side pressure sensor 42 detects a pressure in the main delivery line 15 between the main hydraulic pump 13 and the directional control valve 22. The pump side pressure sensor 42 detects a pressure of the pressurized oil delivered to the main delivery line 15 from the main hydraulic pump 13, as a main pressure shown at step 6 in FIG. 7, and outputs the detection signal to the controller 45.

A display monitor 43 forms a notification device that notifies an operator of a degradation state of the accumulator 29 or the like to issue a warning. When a later-described accumulator degradation determination processing section 47 of the controller 45 determines degradation of the accumulator 29, the display monitor 43 will be operated. The display monitor 43 notifies the operator of the degradation state of the accumulator 29 by display of a monitor screen. A reset switch 44 is a reset device that is reset at the time the accumulator 29 is replaced. The controller 45 receives input that the accumulator 29 is replaced from the reset switch 44. It should be noted that the notification device is not limited to the display monitor 43, but may include a voice synthesizer, a notification lamp or a buzzer, for example.

Figure 6:
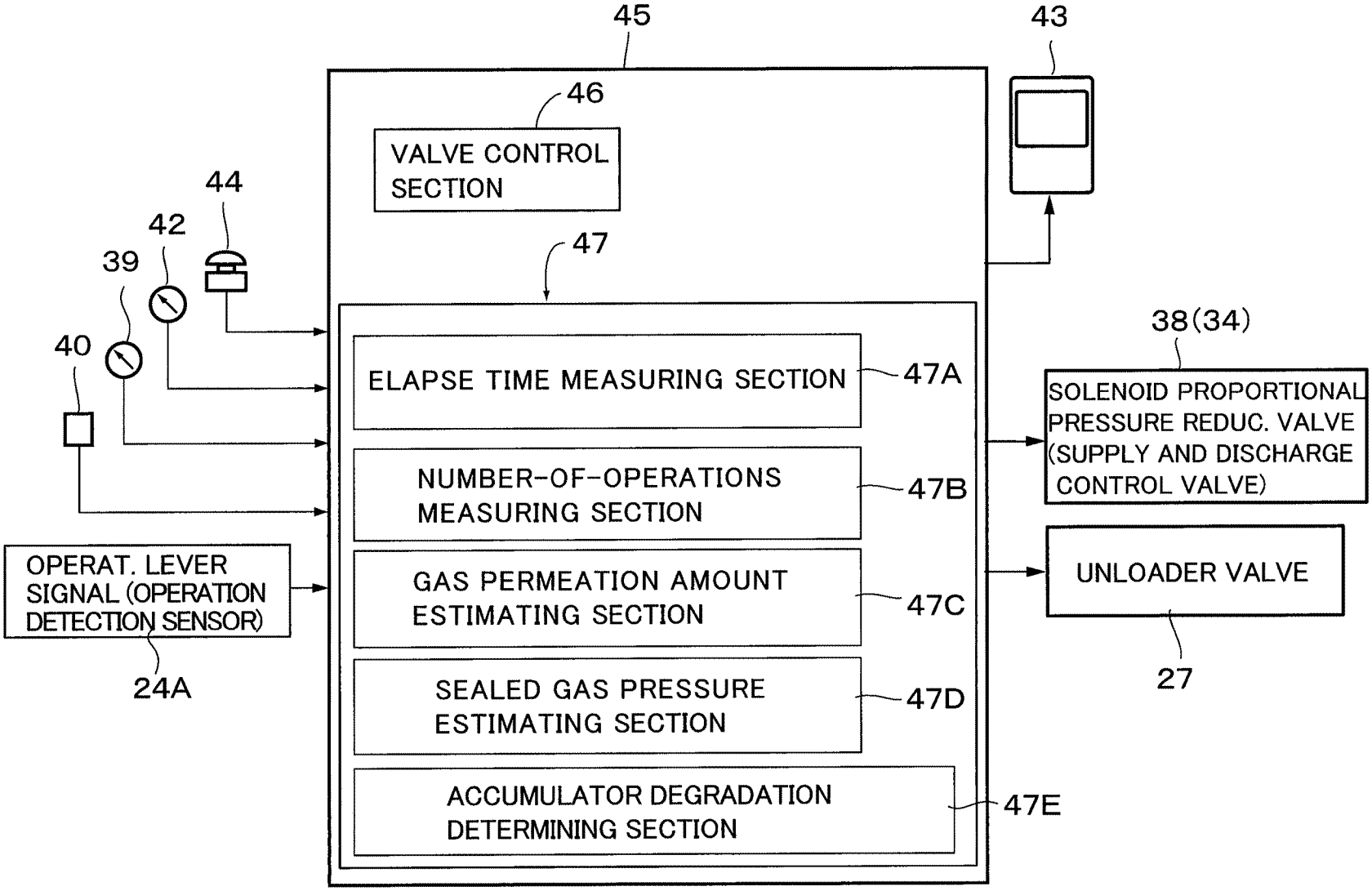
FIG. 6 is a control block diagram of a controller shown in FIG. 2.

The controller 45 is a control device configured to perform switch control of the unloader valve 27 and the solenoid proportional pressure reducing valve 38, and is formed of a microcomputer, for example. As shown in FIG. 6, the controller 45 is provided with, for example, a valve control section 46 configured to perform the switch control of the unloader valve 27 and the solenoid proportional pressure reducing valve 38, and the accumulator degradation determination processing section 47 configured to perform the degradation determination of the accumulator 29 as described later. The controller 45 has an input side to which the operation detection sensor 24A attached to the operation lever device 24, the accumulator side pressure sensor 39 as the pressure detector, the temperature sensor 40 as the temperature detector, the pump side pressure sensor 42 and the reset switch 44 as the reset device are connected.

That is, the controller 35 is subjected to input of the delivery pressure (the main pressure) of the main hydraulic pump 13 detected by the pump side pressure sensor 42, the pressure of the accumulator 29 (the accumulator pressure Pa) detected by the accumulator side pressure sensor 39, the temperature of the hydraulic oil detected by the temperature sensor 40 (that is, a temperature in the hydraulic supply and discharge line 33 to which the oil chamber 29A of the accumulator 29 is connected), a reset signal from the reset switch 44, and an operation lever signal from the operation detection sensor 24A for detecting the operation of the operation lever device 24, respectively.

The controller 45 has an output side to which the solenoid pilot part 27A of the unloader valve 27, the solenoid proportional pilot part 38A of the solenoid proportional pressure reducing valve 38, and the display monitor 43 as the notification device are connected. The signal for controlling and switching the unloader valve 27, the signal for variably controlling the pilot pressure by the solenoid proportional pressure reducing valve 38 for controlling and switching the supply and discharge control valve 34, and the signal for displaying an image for notifying an operator of the degradation state of the accumulator 29 by the display monitor 43 are outputted from the controller 45 as described before.

As shown in FIG. 6, the accumulator degradation determination processing section 47 of the controller 45 is provided with an elapse time measuring section 47A, a number-of-operations measuring section 47B, a gas permeation amount estimating section 47C, a sealed gas pressure estimating section 47D and an accumulator degradation determining section 47E. The elapse time measuring section 47A measures an elapse time tx elapsed since an initial use of the accumulator 29 by the reset signal from the reset switch 44 (refer to step 11 in FIG. 8). The number-of-operations measuring section 47B counts the number of operations of the accumulator 29, that is, the number of times N of boom lowering operations after the reset by the detection signal from the accumulator side pressure sensor (refer to step 15 in FIG. 8). The gas permeation amount estimating part 47C calculates and estimates an estimation gas permeation amount Qloss (refer to Formula 1 to be described later) of the accumulator 29 based upon outputs of the elapse time measuring section 47A, the accumulator side pressure sensor 39 and the temperature sensor 40 (refer to step 16 in FIG. 8). The sealed gas pressure estimating section 47D calculates and estimates an estimation sealed gas pressure Pgs of the gas chamber 29B of the accumulator 29 from a rising state of the pressure of the accumulator 29 (a pressure rising rate) based upon the detection signal from the accumulator side pressure sensor 39 (refer to step 17 in FIG. 8). The accumulator degradation determining section 47E determines a degradation condition of the accumulator 29 based upon at least one output of the elapse time measuring section 47A, the number-of-operations measuring section 47B, the gas permeation amount estimating section 47C, and the sealed gas pressure estimating section 47D, and outputs the determination result (refer to steps 12 and 13 in FIG. 8).

The valve control section 46 of the controller 45 determines to which hydraulic circuit of the main hydraulic circuit 11A (the main delivery line 15) and the pilot hydraulic circuit 11B (the pilot delivery line 21) the pressurized oil accumulated in the accumulator 29 should be supplied, and controls the supply and discharge control valve 34 via the solenoid proportional pressure reducing valve 38 according to the determination result. In this case, the controller 45 controls the supply and discharge control valve 34 via the solenoid proportional pressure reducing valve 38 in accordance with the accumulator pressure Pa (refer to FIG. 10) detected by the accumulator side pressure sensor 39 and the main pressure of the main delivery line 15 detected by the pump side pressure sensor 42. In addition, along with it, the valve control section 46 of the controller 45 controls and switches the unloader valve 27 in accordance with the pressure of the accumulator 29 detected by the accumulator side pressure sensor 39.

The controller 45 has a memory 45A including, for example, a flash memory, a ROM, a RAM and/or an EEPROM. The memory 45A has a program (for example, a program for executing the control processing shown in FIG. 7) for use in control processing of the solenoid proportional pressure reducing valve 38 (the supply and discharge control valve 34) and the unloader valve 27, a processing program for executing determining the degradation state of the accumulator 29 (refer to FIG. 8), and a first set pressure Ps1 and a second set pressure Ps2 (Ps1>Ps2) preset for comparison and determination of the pressure in the accumulator 29, and the like, which are stored therein.

Here, the first set pressure Ps1 is a pressure that serves as a determination reference for making a determination on whether the pressurized oil from the oil chamber 29A of the accumulator 29 should be supplied to the main hydraulic circuit 11A (the main delivery line 15) or the pilot hydraulic circuit 11B (the pilot delivery line 21). That is, the first set pressure Ps1 is in advance found through experiments, calculations, simulations and the like such that the pressurized oil from the accumulator 29 can be efficiently utilized for any of the main hydraulic circuit 11A and the pilot hydraulic circuit 11B. Thereby, the first set pressure Ps1 may be set as a pressure slightly higher (for example, higher by approximately 0.5 to 1 MPa) than the pilot pressure (that is, a low-pressure set value Ps0 by the low-pressure relief valve 26) in the pilot delivery line 21.

In addition, the second set pressure Ps2 is a pressure that serves as a determination reference for switching the unloader valve 27 from the closed position to the open position. That is, when the unloader valve 27 is switched from the closed position to the open position, a pilot pressurized oil (a primary pressure) is supplied from the accumulator 29 to the operation lever device 24. At this time, since the pilot pressurized oil from the pilot hydraulic pump 20 is discharged from the unloader valve 27 to the hydraulic oil tank 14, it is possible to reduce the rotational load (the output) of the pilot hydraulic pump 20. The second set pressure Ps2 is a pressure in advance found through experiments, calculations, simulations and the like. Thereby, the second set pressure Ps2 may be set as a pressure slightly lower (for example, smaller by approximately 0.5 MPa) than the pilot pressure (that is, the low-pressure set value Ps0 by the low-pressure relief valve 26) in the pilot delivery line 21.

In a case where the pressure in the accumulator 29 (the accumulator pressure Pa) exceeds the first set pressure Ps1, the controller 45 controls the supply and discharge control valve 34 such that the pressurized oil from the accumulator 29 is supplied to the main hydraulic circuit 11A (the main delivery line 15). That is, when the accumulator pressure Pa detected by the accumulator side pressure sensor 39 exceeds the first set pressure Ps1, the controller 45 switches the solenoid proportional pressure reducing valve 38 to the pressure reducing position (b) as shown in FIG. 5, and causes the hydraulic pilot part 34B of the supply and discharge control valve 34 to be communicated with the hydraulic oil tank 14. Therefore, the supply and discharge control valve 34 is switched to the main-side position (E) by the spring 34A to supply the pressurized oil in the accumulator 29 to the main delivery line 15.

In addition, in a case where the accumulator pressure Pa is lower than the first set pressure Ps1, the controller 45 controls the supply and discharge control valve 34 such that the pressurized oil from the accumulator 29 is supplied to the pilot hydraulic circuit 11B (the pilot delivery line 21). That is, when the pressure Pa in the accumulator 29 detected by the accumulator side pressure sensor 39 is lower than the first set pressure Ps1, the controller 45 switches the solenoid proportional pressure reducing valve 38 to the communication position (a) as shown in FIG. 3 to communicate the hydraulic pilot part 34B of the supply and discharge control valve 34 with the pilot regeneration line 37 (the pilot primary pressure supply path). Therefore, the supply and discharge control valve 34 is switched to the pilot-side position (F) against the spring 34A, and the pressurized oil from the accumulator 29 is supplied to the pilot regeneration line 37 and the pilot delivery line 21 (or the pressurized oil in the pilot delivery line 21 is supplied to the accumulator 29 as needed).

In this way, when the pressurized oil from the accumulator 29 is being supplied to the pilot delivery line 21, the controller 45 outputs a signal for switching the unloader valve 27 to the open position. That is, the controller 45 performs control of opening the unloader valve 27 when the pressure Pa in the accumulator 29 is lower than the first set pressure Ps1 and also exceeds the second set pressure Ps2, and the pilot pressurized oil to be supplied to the operation lever device 24 is supplied with the pressurized oil from the pilot regeneration line 37 (that is, the pressurized oil from the accumulator 29). Thereby, the rotational load of the pilot hydraulic pump 20 by the engine 12 can be reduced to suppress the fuel consumption amount of the engine 12.

Figure 9:
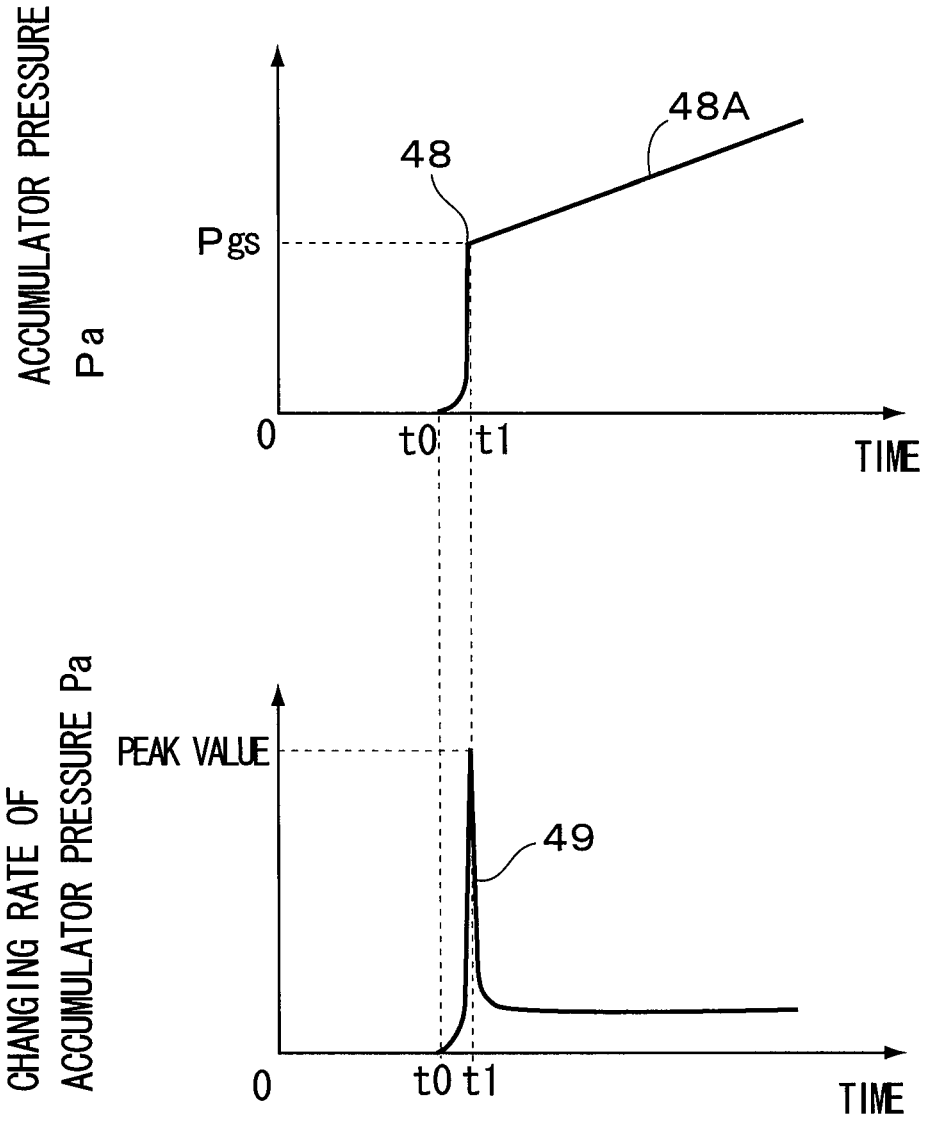
FIG. 9 is a characteristic line diagram at the time of estimating and calculating a gas pressure sealed in a gas chamber of the accumulator.

A characteristic line 48 shown in FIG. 9 shows a pressure characteristic when the accumulator pressure Pa in the oil chamber 29A rises up (at the pressure rise) from the tank pressure state. In a case where an initial pressure of the gas sealed in the gas chamber 29B of the accumulator 29 is Pgs, the accumulator pressure Pa in the oil chamber 29A abruptly rises at time t0 until exceeding the initial pressure Pgs of the gas. After time t1, the oil chamber 29A is expanded and the gas chamber 29B is compressed and thereby the accumulator pressure Pa in the oil chamber 29A gradually increases as a characteristic line part 48A. Until a pressure in the oil chamber 29A of the accumulator 29 exceeds the pressure of the gas sealed in the gas chamber 29B of the accumulator 29, the oil chamber 29A of the accumulator 29 is maintained in the state. When the pressure of the oil chamber 29A exceeds the pressure of the sealed gas, in a case of the piston type accumulator, the piton performs strokes, and in a case of the bladder type accumulator, the bladder contracts.

Therefore, a pressure characteristic at the time the accumulator pressure Pa in the oil chamber 29A rises up from the tank pressure is as shown in the characteristic line 48 shown in FIG. 9. Until the accumulator pressure Pa in the oil chamber 29A is equal to the initial pressure Pgs of the gas sealed in the gas chamber 29B, a volume of the oil chamber 29A of the accumulator 29 does not change. Therefore, the accumulator pressure Pa abruptly rises due to compressibility of the gas in the gas chamber 29B. However, when the accumulator pressure Pa exceeds the initial pressure Pgs, since a volume of each of the oil chamber 29A and the gas chamber 29B in the accumulator 29 begins to change, the rise in the accumulator pressure Pa becomes gradual as the characteristic line part 48A.

A characteristic line 49 shown in the lower side in FIG. 9 shows a changing rate (a differential value of the pressure Pa) of the accumulator pressure Pa. In time of a horizontal axis, for example, as shown in FIG. 4 as a time when the recovery control valve 31 is switched to the open position and the supply and discharge control valve 34 is switched to the block position (D) is indicated at t0, and a time when the accumulator pressure Pa reaches the initial pressure Pgs is indicated at t1, the changing rate of the accumulator pressure Pa reaches a peak value near the time t1, and thereafter, abruptly lowers. Therefore, the accumulator pressure Pa at t1 when the changing rate of the accumulator pressure Pa has reached the peak value is the initial pressure Pgs. This pressure can be found as an estimation sealed gas pressure Pgs shown in step 17 in FIG. 8.

Figure 10:
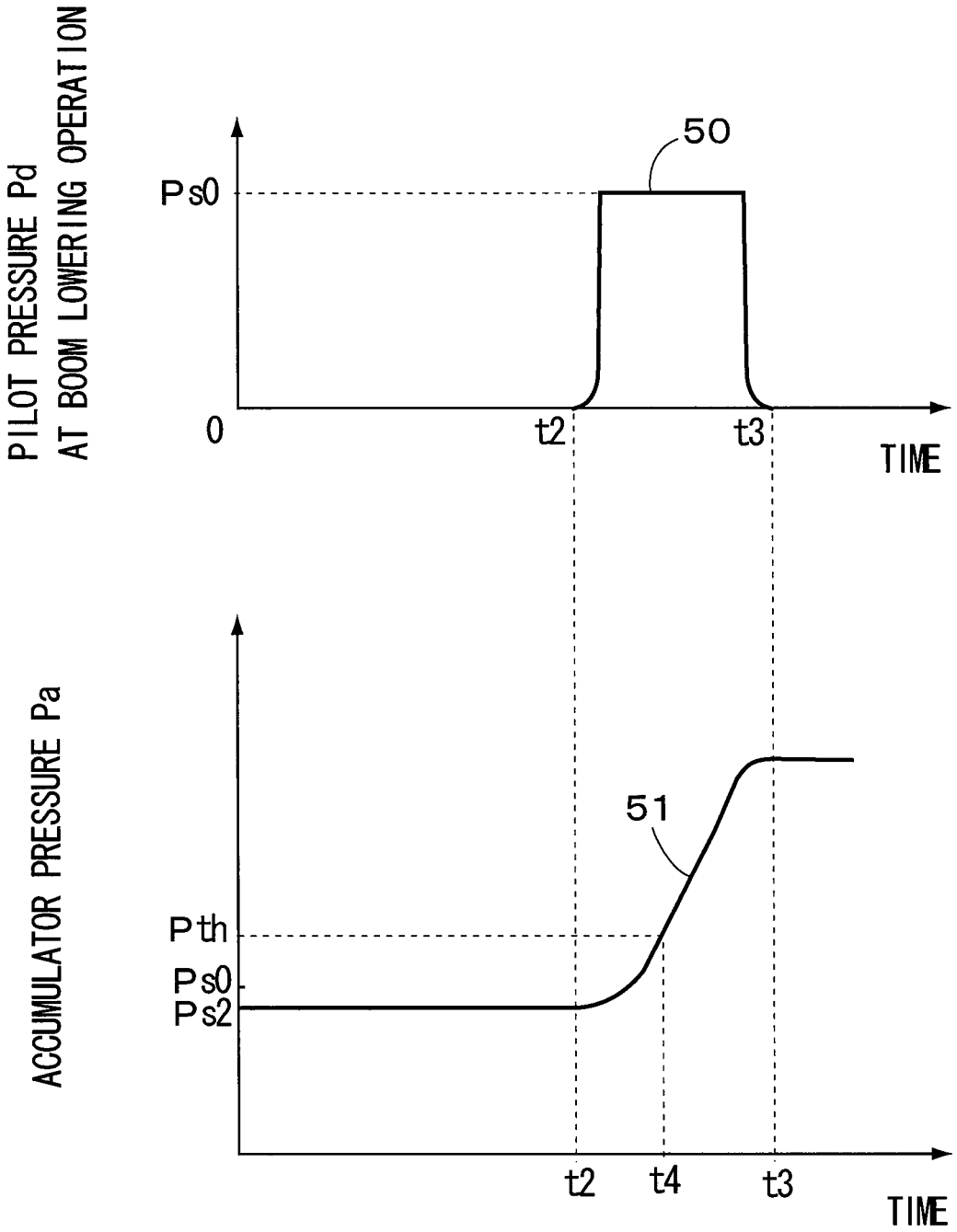
FIG. 10 is a characteristic line diagram showing characteristics of an accumulator pressure to be accumulated in an oil chamber of the accumulator at the boom lowering operation.

A characteristic line 50 shown in FIG. 10 shows a characteristic of a pilot pressure Pd at the boom lowering operation, and a characteristic line 51 shows a characteristic of the accumulator pressure Pa. When the operation lever device 24 begins to be tilted to the boom lowering side at time t2, the pilot pressure Pd at the boom lowering operation is generated in the contracting-side pilot line 25B and the branch pilot line 25B1 as the characteristic line 50. The boom lowering operation by the operation lever device 24 is performed over time t2 to t3. The pilot pressure Pd is risen to the low-pressure set value Ps0 of the low-pressure relief valve 26.

At this time, the directional control valve 22 is switched from the neutral position (A) to the switch position (C) in the boom lowering side. Thereby, the pressurized oil from the main hydraulic pump 13 is delivered to the rod side oil chamber 5D5 of the hydraulic cylinder 5D via the rod side line 18. The returned oil (the pressurized oil) from the bottom side oil chamber 5D4 of the hydraulic cylinder 5D is recovered (accumulated) in the oil chamber 29A in the accumulator 29 via the bottom side line 17, the pilot check valve 19, the recovery line 30, the recovery control valve 31 and the recovery check valve 32.

Therefore, the accumulator pressure Pa in the oil chamber 29A is increased after time t2 as the characteristic line 51 shown in FIG. 10, and also after the pilot pressure Pd at the boom lowering operation is lowered at time t3, the accumulator pressure Pa is maintained in a high-pressure state (that is, the accumulator 29 is in the accumulation state). Here, a pressure threshold value Pth shown in FIG. 10 is a threshold value at the time of counting the number N of the boom lowering operations, and as the accumulator pressure Pa increases to the preset pressure threshold value Pth or more after time t4, the number N of the boom lowering operations advances one by one as [N←N+1] for each time.

The pressure threshold value Pth is set to a pressure higher than the pressure (the second set pressure Ps2) as the determination reference for switching the unloader valve 27 from the closed position to the open position. Therefore, in a state as shown in FIG. 3, the pressure of the oil chamber 29A of the accumulator 29 (the accumulator pressure Pa) does not exceed the low-pressure set value Ps0 of the low-pressure relief valve 26 connected to the pilot regeneration line 37, and the number N of the boom lowering operations is not counted or increased. Further, in the state as shown in FIG. 3, the supply and discharge control valve 34 is switched to the pilot-side position (F), and the oil chamber 29A of the accumulator 29 and the pilot regeneration line 37 are connected via the supply and discharge control valve 34.

The hydraulic excavator 1 according to the present embodiment has the configuration as described above, and an operation thereof will be described below.

FIG. 2 shows a state before startup of the engine 12, and the main hydraulic circuit 11A, the pilot hydraulic circuit 11B and the recovery hydraulic circuit 11C of the hydraulic circuit 11 are in the stop state.

In this case, since the engine 12 is stopped and the main hydraulic pump 13 and the pilot hydraulic pump 20 are also stopped, the pressure of the pilot regeneration line 37 is equal to the tank pressure, and the pilot pressure of each of the extending-side pilot line 25A and the contracting-side pilot line 25B is also equal to the tank pressure. Since the pressure of the pilot regeneration line 37 is the tank pressure, the output of the solenoid proportional pressure reducing valve 38 also becomes the tank pressure, and the supply and discharge control valve 34 is maintained in the main-side position (E) by the spring 34A.

In this way, since the supply and discharge control valve 34 is in the main-side position (E), the hydraulic supply and discharge line 33 to which the oil chamber 29A of the accumulator 29 is connected is connected to the main delivery line 15 of the main hydraulic pump 13 via the main check valve 36 and the main regeneration line 35. However, the main delivery line 15 is equal to the tank pressure by the stopping of the engine 12. Therefore, the hydraulic supply and discharge line 33 to which the oil chamber 29A of the accumulator 29 is connected is also equal to the tank pressure. In addition, the pilot check valve 19 is in the closed state, and the recovery control valve 31 is also maintained in the closed position.

Next, FIG. 3 shows a state where the engine 12 is worked and all of the operation lever device 24 and the like are in the neutral position.

In this case, when the operator who gets on the cab 7 starts the engine 12, the main hydraulic pump 13 and the pilot hydraulic pump 20 are driven by the engine 12. The maximum pressure of the pressurized oil delivered from the main hydraulic pump 13 to the main delivery line 15 is controlled by the high-pressure relief valve 23, and the pressure of the main delivery line 15 is held in the pressure set by the high-pressure relief valve 23. The maximum pressure of the pilot pressurized oil delivered from the pilot hydraulic pump 20 to the pilot delivery line 21 is controlled by the low-pressure relief valve 26, and the pressure of each of the pilot delivery line 21 and the pilot regeneration line 37 is held in the pressure set by the low-pressure relief valve 26.

Figure 7:
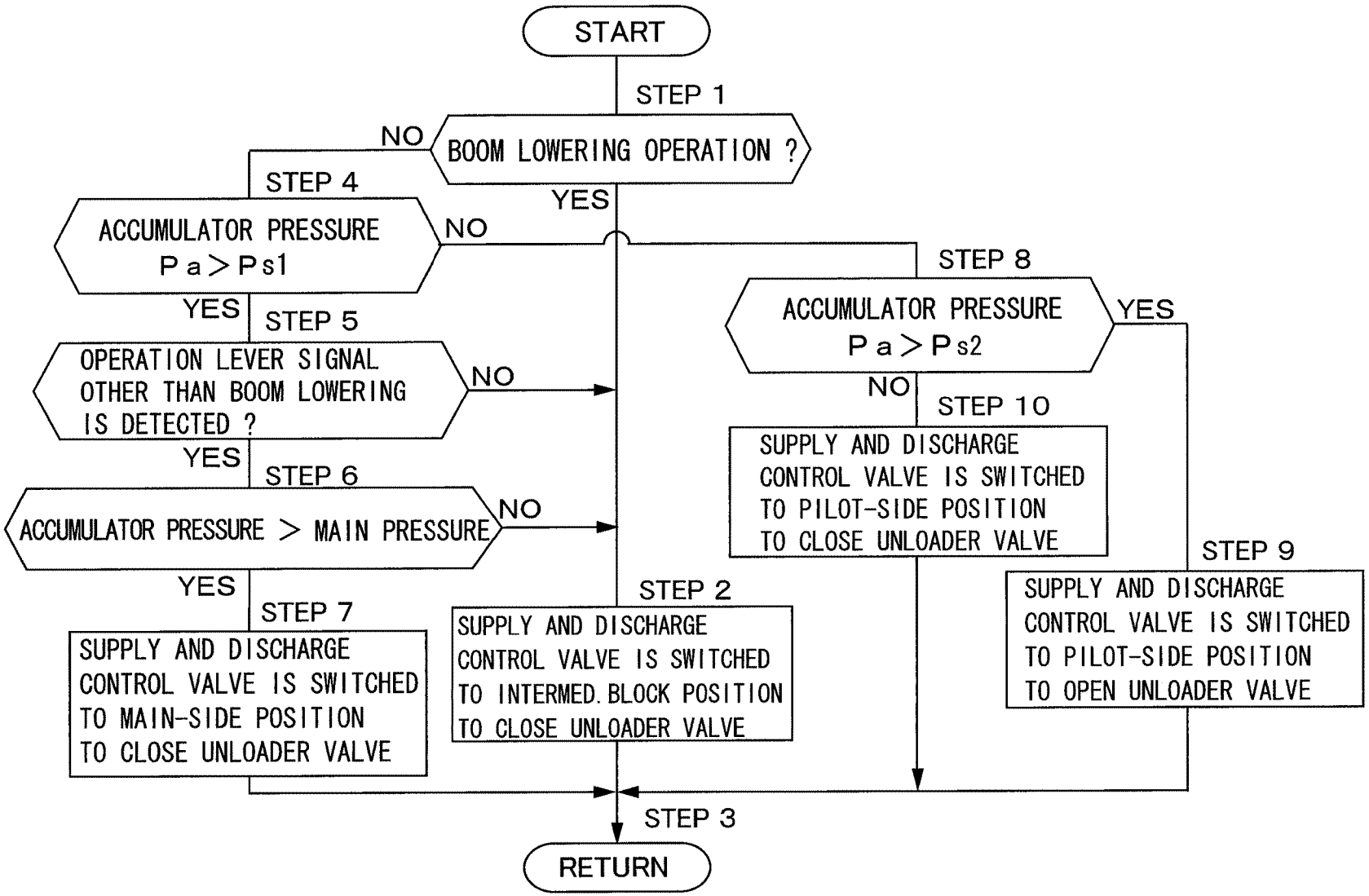
FIG. 7 is a flow chart showing control processing for switching a supply and discharge control valve via a solenoid proportional pressure reducing valve by the controller, and control processing of an unloader valve.

Here, the unloader valve 27 and the solenoid proportional pressure reducing valve 38 are controlled according to the control processing in FIG. 7 by the valve control section 46 of the controller 45 shown in FIG. 6. When the current value of the control signal outputted from the valve control section 46 of the controller 45 is zero, the solenoid proportional pressure reducing valve 38 becomes to the communication position (a) as shown in FIG. 3. Therefore, the solenoid proportional pressure reducing valve 38, for example, supplies the pressure of the pilot pressurized oil supplied from the pilot hydraulic pump 20 via the pilot delivery line 21 and the pilot regeneration line 37 (the pilot primary pressure supply path) to the hydraulic pilot part 34B of the supply and discharge control valve 34 without reducing it. Thereby, the supply and discharge control valve 34 is operated to be switched from the main-side position (E) to the pilot-side position (F) according to the pilot pressure at this time.

As shown in FIG. 3, while the unloader valve 27 is in the closed position, the pressurized oil delivered from the pilot hydraulic pump 20 is introduced to the oil chamber 29A in the accumulator 29 via the pilot delivery line 21, the check valve 28, the pilot regeneration line 37, the supply and discharge control valve 34 and the hydraulic supply and discharge line 33. As the pressurized oil delivered from the pilot hydraulic pump 20 is accumulated (recovered) in the oil chamber 29A in the accumulator 29, a pressure of the oil path (that is, the hydraulic supply and discharge line 33, the pilot regeneration line 37 and the pilot delivery line 21) connected to the oil chamber 29A in the accumulator 29 gradually increases.

When the accumulator pressure Pa in the oil chamber 29A is higher than the second set pressure Ps2, for example at step 8 in FIG. 7 "Pa>Ps2" is determined. At the next step 9, in a state where the supply and discharge control valve 34 is maintained in the pilot-side position (F) by the solenoid proportional pressure reducing valve 38, the unloader valve 27 is switched from the closed position to the open position. When the unloader valve 27 is opened, the pressurized oil delivered from the pilot hydraulic pump 20 is released to the hydraulic oil tank 14 via the unloader valve 27.

At this time, the supply and discharge control valve 34 is in the pilot-side position (F) and the pilot regeneration line 37 and the oil chamber 29A of the accumulator 29 are connected via the supply and discharge control valve 34. Therefore, the pressurized oil accumulated in the oil chamber 29A of the accumulator 29 is supplied to the operation lever device 24 via the supply and discharge control valve 34 and the pilot regeneration line 37. Therefore, the pilot pressurized oil to be supplied to the operation lever device 24 can be supplied by the pressurized oil from the pilot regeneration line 37 (that is, the pressurized oil from the accumulator 29). Thereby, the rotational load of the pilot hydraulic pump 20 by the engine 12 can be reduced to suppress the fuel consumption amount of the engine 12. It should be noted that while the unloader valve 27 is opened, the pressurized oil of the pilot regeneration line 37 does not flow back to the pilot delivery line 21-side and the pilot hydraulic pump 20-side by an operation of the check valve 28.

Even in a case where all of the operation lever devices including the operation lever device 24 are in the neutral position, in some cases the pressurized oil leaks from the pressure reducing valve of the operation lever device 24 connected to the pilot regeneration line 37 or the solenoid proportional pressure reducing valve 38. Since the pressurized oil leaks to the hydraulic oil tank 14 from the pilot regeneration line 37 a little by a little by this leak, the pressure in the pilot regeneration line 37 gradually reduces. Therefore, in some cases the pressure in the hydraulic supply and discharge line 33 and in the pilot regeneration line 37 to which the oil chamber 29A of the accumulator 29 is connected becomes smaller than the second set pressure Ps2. In such a case, the unloader valve 27 is closed by the processing of step 10 in FIG. 7, for example, and the pressure in the pilot regeneration line 37 increases by the pilot pressurized oil delivered from the pilot hydraulic pump 20.

In this way, in a case where all of the operation lever devices are in the neutral position, the pressure in the pilot regeneration line 37 is maintained in the second set pressure Ps2 by repeat of the opening and closing of the unloader valve 27. At this time, the second set pressure Ps2 is set to a lower pressure as shown in FIG. 10 than the valve opening pressure (the low-pressure set value Ps0) of the low-pressure relief valve 26 connected to the pilot regeneration line 37. Therefore, the low-pressure relief valve 26 does not work.

Next, FIG. 4 shows a case of performing the boom lowering operation in a state where the engine 12 is being worked.

In this case, in the working state of the engine 12, the pressurized oil delivered from the main hydraulic pump 13 and the pilot hydraulic pump 20 is delivered to the traveling hydraulic motor, the revolving hydraulic motor, and the boom cylinder 5D, the arm cylinder 5E and the bucket cylinder 5F in the working mechanism 5 in response to the lever operation and the pedal operation of the traveling operating device and the working operating device (the operation lever device 24) provided in the cab 7. Therefore, there will be considered a case of performing the boom lowering operation by the operation lever device 24.

As described before, in a case where all of the operation lever devices are in the neutral position, the pressure in the pilot regeneration line 37 and the oil chamber 29A of the accumulator 29 is maintained in the second set pressure Ps2. In this state, when the boom lowering operation is performed by the operation lever device 24, the pilot pressure in the contracting-side pilot line 25B is supplied to the hydraulic pilot part 22B of the directional control valve 22, and the directional control valve 22 is switched to the switch position (C) in the boom lowering operation side. Therefore, the pressurized oil delivered from the main hydraulic pump 13 by the working of the engine 12 is supplied to the rod side line 18 via the main delivery line 15 and the directional control valve 22, causing stroke of the hydraulic cylinder 5D in the contracting direction.

At this time, the pilot pressure from the branch pilot line 25B1 (the pilot pressure Pd at the boom lowering operation shown in FIG. 10) is introduced also to the pilot check valve 19 and the recovery control valve 31, forcibly causing the pilot check valve 19 to be opened and switching the recovery control valve 31 to the open position. Therefore, the returned oil from the bottom side oil chamber 5D4 of the hydraulic cylinder 5D is introduced to the bottom side line 17 via the pilot check valve 19, and a part thereof is discharged to the hydraulic oil tank 14 via the throttle 22C of the directional control valve 22 and the return line 16. However, a large part of the remaining returned oil (the pressurized oil) is introduced to the hydraulic supply and discharge line 33 to which the oil chamber 29A of the accumulator 29 is connected, via the recovery control valve 31 and the recovery check valve 32.

Here, the valve control section 46 of the controller 45 outputs the control signal to the solenoid proportional pilot part 38A of the solenoid proportional pressure reducing valve 38 to cause the solenoid proportional pressure reducing valve 38 to be operated to be switched between the communication position (a) and the pressure reducing position (b). Therefore, the solenoid proportional pressure reducing valve 38 reduces a pilot pressure from the pilot regeneration line 37 (the pilot primary pressure supply path) to the intermediate pressure, for example, and supplies this pilot pressure to the hydraulic pilot part 38B of the supply and discharge control valve 34. Thereby, the supply and discharge control valve 34 is operated to be switched to the intermediate block position (D) according to the pilot pressure as the intermediate pressure. At step 1 shown in FIG. 7, when "YES" is determined to the boom lowering operation, the process transfers to step 2, wherein the solenoid proportional pressure reducing valve 38 is controlled such that the supply and discharge control valve 34 is in the intermediate block position (D).

Therefore, the hydraulic supply and discharge line 33 is blocked to both of the main regeneration line 35 and the pilot regeneration line 37 by the supply and discharge control valve 34, and a large part of the aforementioned returned oil (the pressurized oil) is introduced to the oil chamber 29A of the accumulator 29. The accumulator pressure Pa in the oil chamber 29A increases as the characteristic line 51 for a period from time t2 to time t3 of performing the boom lowering operation as shown in FIG. 10 by the returned oil from the hydraulic cylinder 5D (the bottom side oil chamber 5D4). Therefore, the accumulator 29 recovers (accumulates) the pressurized oil at this time. At this time, for example, by using a force, which is generated by the self-weight of the boom 5A, of contracting the hydraulic cylinder 5D, the accumulator 29 can accumulate (charge) the pressurized oil in the bottom side oil chamber 5D4 of the hydraulic cylinder 5D.

Next, FIG. 5 shows a case of performing the boom raising operation in a state where the engine 12 is being worked.

Here, when the boom raising operation is performed by the operation lever device 24, the pilot pressure from the extending-side pilot line 25A is supplied to the hydraulic pilot part 22A of the directional control valve 22, and the directional control valve 22 is switched to the switch position (B) in the boom raising operation side. Therefore, the pressurized oil delivered from the main hydraulic pump 13 by the working of the engine 12 is supplied to the bottom side oil chamber 5D4 from the bottom side line 17 via the main delivery line 15 and the directional control valve 22, causing stroke of the hydraulic cylinder 5D in the extending direction.

At this time, the returned oil from the rod side oil chamber 5D5 of the hydraulic cylinder 5D is discharged to the hydraulic oil tank 14 via the rod side line 18, the directional control valve 22 and the return line 16. However, in this case, the main regeneration line 35 causes the oil chamber 29A of the accumulator 29 to be communicated with the main delivery line 15 when the supply and discharge control valve 34 is switched to the main-side position (E) to be connected to the hydraulic supply and discharge line 33 (that is, to the oil chamber 29A of the accumulator 29). Thereby, the pressurized oil that has been once recovered (accumulated) in the accumulator 29 flows in such a manner as to be regenerated from the main regeneration line 35 to the main delivery line 15, and the regenerated oil at this time is joined to the pressurized oil delivered to the main delivery line 15 from the main hydraulic pump 13.

At the boom raising operation shown in FIG. 5, a control signal is outputted to the solenoid proportional pilot part 38A of the solenoid proportional pressure reducing valve 38 from the valve control section 46 of the controller 45 to increase a current value of the solenoid proportional pilot part 38A, and thereby, the solenoid proportional pressure reducing valve 38 is switched to the pressure reducing position (b). Thereby, the hydraulic pilot part 34B of the supply and discharge control valve 34 is communicated with the hydraulic oil tank 14 via the solenoid proportional pressure reducing valve 38, and the supply and discharge control valve 34 is switched to the main-side position (E) by the spring 34A. Therefore, the oil chamber 29A of the accumulator 29, the main regeneration line 35 and the main delivery line 15 are connected, and the pressurized oil in the accumulator 29 is supplied to the bottom side oil chamber 5D4 of the hydraulic cylinder 5D via the directional control valve 22 in the switch position (B), for example.

As a result, at the full operation of the operation lever device 24, the pressurized oil delivered to the main delivery line 15 from the main hydraulic pump 13 and the regenerated oil from the main regeneration line 35 are jointed to each other. Accordingly, a flow rate of the pressurized oil to be supplied to the bottom side oil chamber 5D4 of the hydraulic cylinder 5D via the directional control valve 22 and the bottom side line 17 can be increased, and an extending speed of the hydraulic cylinder 5D can be increased. Thereby, the pressurized oil in the accumulator 29 is released from the main regeneration line 35 to the main delivery line 15, making it possible to assist in the extending operation of the hydraulic cylinder 5D, so that the load of the main hydraulic pump 13 can be reduced to suppress the fuel consumption amount of the engine 12.

Next, an explanation will be made of the control processing of the solenoid proportional pressure reducing valve 38 (the supply and discharge control valve 34) and the unloader valve 27 by the valve control section 46 of the controller 45 with reference to FIG. 7.

First, when the processing operation is started by the start of the engine 12, it is determined at step 1 whether or not the boom lowering operation is performed. This is a determination on whether or not the boom lowering operation is performed such that the directional control valve 22 is switched to the switch position (C), based upon the operation lever signal of the operation lever device 24 detected by the operation detecting sensor 24A.

When "YES" is determined at step 1, at the next step 2, the solenoid proportional pressure reducing valve 38 is controlled to be switched in solenoid proportion between the communication position (a) and the pressure reducing position (b) in such a manner as to switch the supply and discharge control valve 34 to the block position (D) shown in FIG. 4. Thereby, the supply and discharge control valve 34 is controlled via the solenoid proportional pressure reducing valve 38 to be in the intermediate block position (D). In addition, the unloader valve 27 is held in the closed position as shown in FIG. 4. At the next step 3 the process returns, causing the process after step 1 to be repeated.

On the other hand, when "NO" is determined at step 1, at the next step 4 it is determined whether or not the accumulator pressure Pa in the oil chamber 29A is larger than the first set pressure Ps1. The first set pressure Ps1 is set to a pressure slightly higher than the pilot pressure in the pilot delivery line 21 (that is, the low-pressure set value Ps0 by the low-pressure relief valve 26). In a case where the accumulator pressure Pa is higher than the first set pressure Ps1, even when the pressurized oil in the accumulator 29 is returned to the pilot hydraulic circuit 11B (the pilot delivery line 21-side), the low-pressure relief valve 26 may possibly open to discharge the pressurized oil. In addition, a pressure loss may be made in the supply and discharge control valve 34, and the energy (the pressurized oil) may not be possibly used effectively.

Therefore, when "YES" is determined at step 4, the process transfers to step 5 for regenerating the pressurized oil in the accumulator 29 in the main hydraulic circuit 11A (the main delivery line 15)-side, wherein it is determined whether or not the operation lever signal other than the boom lowering is outputted, by the detection signal from the operation detection sensor 24A. When "YES" is determined at step 5, at the next step 6 it is determined whether or not the accumulator pressure Pa is larger than the main pressure (that is, a delivery pressure of the main hydraulic pump 13). At this time, the main pressure is detected by the pump side pressure sensor 42, and the accumulator pressure Pa is detected by the accumulator side pressure sensor 39.

When "YES" is determined at step 6, at the next step 7 the solenoid proportional pressure reducing valve 38 is controlled to be switched to the pressure reducing position (b) in such a manner as to switch the supply and discharge control valve 34 to the main-side position (E) shown in FIG. 5. Thereby, the supply and discharge control valve 34 is controlled via the solenoid proportional pressure reducing valve 38 to be in the main-side position (E). Therefore, the pressurized oil accumulated in the accumulator 29 flows to be regenerated from the main regeneration line 35 to the main delivery line 15, and the regenerated oil at this time is jointed to the pressurized oil delivered to the main delivery line 15 from the main hydraulic pump 13. In addition, the unloader valve 27 is held in the closed position as shown in FIG. 5.

On the other hand, when "NO" is determined at step 5 and at step 6, the process transfers to step 2, wherein the supply and discharge control valve 34 is switched to the block position (D) as described before, and the unloader valve 27 is held in the closed position. In addition, also in this case the process returns at step 3, causing the process after step 1 to be repeated.

On the other hand, when "NO" is determined at step 4, the pressure in the accumulator 29 (the accumulator pressure Pa) is equal to or less than the first set pressure Ps1. Therefore, in a case where the pressurized oil in the accumulator 29 is returned to the pilot hydraulic circuit 11B (the pilot delivery line 21-side), the energy (the pressurized oil) can be determined to be used effectively in the pilot hydraulic circuit 11B-side. Therefore, at the next step 8 it is determined whether or not the accumulator pressure Pa is larger than the second set pressure Ps2. The second set pressure Ps2 is set to a pressure slightly lower than the pilot pressure in the pilot delivery line 21 (the low-pressure set value Ps0 by the low-pressure relief valve 26).

When "YES" is determined at step 8, the accumulator pressure Pa is higher than the second set pressure Ps2, and is equal to or less than the first set pressure Ps1. Therefore, as shown in FIG. 3, the solenoid proportional pressure reducing valve 38 is switched to the communication position (a) for switching the supply and discharge control valve 34 to the pilot-side position (F) at the next step 9. Thereby, for example, the pilot pressurized oil delivered from the pilot hydraulic pump 20 via the pilot delivery line 21 and the pilot regeneration line 37 is supplied to the hydraulic pilot part 34B of the supply and discharge control valve 34 without a reduction in pressure. Thereby, the supply and discharge control valve 34 is operated to be switched to the pilot-side position (F) according to the pilot pressure at this time.

In addition, at step 9, the unloader valve 27 is switched to the open position. Therefore, the pilot pressurized oil from the pilot hydraulic pump 20 is discharged to the hydraulic oil tank 14 via the unloader valve 27, and thereby, the load of the pilot hydraulic pump 20 can be suppressed to reduce the fuel consumption of the engine 12. In addition, at the tilting operation of the operation lever device 24, the pressurized oil from the accumulator 29 can be supplied to the operation lever device 24 via the supply and discharge control valve 34 in the pilot-side position (F) and the pilot regeneration line 37. Thereby, the operation lever device 24 can supply the pilot pressure (the secondary pressure) to the directional control valve 22 via the pilot line 25A or 25B at the lever operation. As a result, also at the opening of the unloader valve 27, the switch position of the directional control valve 22 is switched, enabling the boom operation desired by the operator.

On the other hand, when "NO" is determined at step 8, the accumulator pressure Pa is equal to or less than the second set pressure Ps2. Therefore, at the next step 10, the supply and discharge control valve 34 is switched to the pilot-side position (F) via the solenoid proportional pressure reducing valve 38, and the unloader valve 27 is returned to the closed position. Thereby, the pilot pressurized oil from the pilot hydraulic pump 20 is delivered to the accumulator 29 via the check valve 28, the supply and discharge control valve 34 and the pilot regeneration line 37. In addition, the pilot pressurized oil from the pilot hydraulic pump 20 is delivered also to the operation lever device 24-side.

Thereby, the pressurized oil necessary for the operation lever device 24 can be ensured, and the accumulation (the charge) of the accumulator 29 can be performed. The accumulation (the charge) of the accumulator 29 by the pressurized oil of the pilot hydraulic pump 20 is performed until a pressure slightly lower than the valve opening pressure (the low-pressure set value Ps0) of the low-pressure relief valve 26, for example. Thereby, the pressurized oil can be suppressed from escaping from the low-pressure relief valve 26 (the energy is prevented from being given up). Thereafter, the process returns at step 3, and the process after step 1 continues to be executed.

Figure 8:
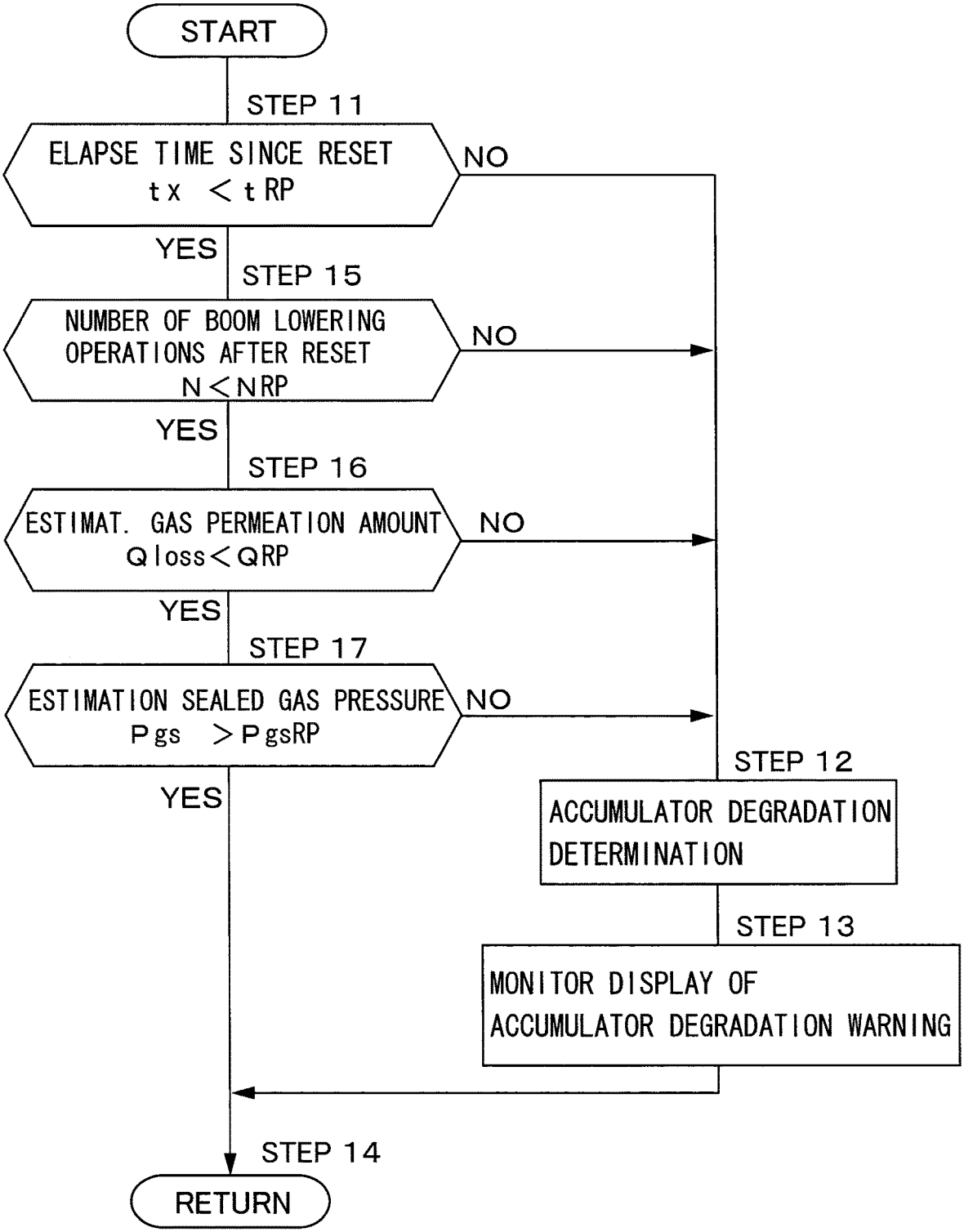
FIG. 8 is a flow chart showing degradation determination processing of the accumulator by the controller.

Next, an explanation will be made of the processing by the accumulator degradation determination processing section 47 of the controller 45 with reference to FIG. 8.

First, when the process operation is started by start of the engine 12, it is determined at step 11 whether or not an elapse time tx elapsed since the reset switch 44 is operated is shorter than a preset time tRP (that is, a replacement timing of the accumulator 29). In a case where "NO" is determined at step 11, since the elapse time tx elapsed since the accumulator 29 is replaced reaches the replacement timing, at the next step 12 a degradation determination of the accumulator 29 is performed. At the next step 13 the display monitor 43 is caused to display an accumulator degradation warning. Thereafter, for example, by performing the replacement of the accumulator 29, the process returns at step 14, and the process after step 11 continues to be executed.

In a case where "YES" is determined at step 11, since the accumulator 29 does not reach the replacement timing, at the next step 15, after the reset switch 44 is operated, it is determined whether or not the number N of the boom lowering operations is smaller than a preset number of times NRP. Here, as shown in FIG. 10, the number N of the boom lowering operations advances one by one as [N←N+1] for each time the accumulator pressure Pa increases to the preset pressure threshold value Pth or more. In other words, for each time the lowering operation of the boom 5A is substantially performed, the number N of the boom lowering operations is counted as [N←N+1].

For example, as shown in FIG. 3, in a case where the supply and discharge control valve 34 is in the pilot-side position (F), the oil chamber 29A of the accumulator 29 and the pilot regeneration line 37 are connected via the supply and discharge control valve 34. In this state, the pressure of the oil chamber 29A of the accumulator 29 does not become the valve opening pressure (the low-pressure set value Ps0) or more of the low-pressure relief valve 26 connected to the pilot regeneration line 37. In this case, it can be determined that the lowering operation of the boom 5A is not performed, and therefore, the number N of the boom lowering operations is not counted or increased.

When "NO" is determined at step 15, the lowering operation of the boom 5A is repeated by many times (the number of times NRP as a threshold value). That is, it can be determined that the accumulator 29 has reached the replacement timing by repeating recovery (accumulation) and release (regeneration) of the pressurized oil by many times. Therefore, also in this case the degradation determination of the accumulator 29 is performed at step 12, and at step 13, the display monitor 43 is caused to display an accumulator degradation warning.

In a case where "YES" is determined at step 15, the number N of the boom lowering operations does not reach the preset number of times NRP (the replacement timing of the accumulator 29). Therefore, at the next step 16, the gas permeation amount in which the pressurized gas sealed in the gas chamber 29B of the accumulator 29 permeates in the oil chamber 29A-side is estimated and calculated. On top of that, it is determined whether or not the estimation gas permeation amount Qloss is smaller than a permeation gas amount QRP as a predetermined threshold value. In this case, the estimation gas permeation amount Qloss is found by calculation according to the following Formula 1.

$$Qloss = Kloss \times tx \times Pav \times Tav \quad \text{[Formula 1]}$$

Here, the estimation gas permeation amount Qloss of Formula 1 as described above is found by multiplying the elapse time tx found at step 11, an average value Pay of the accumulator pressure Pa, an average temperature Tav of hydraulic fluid and a predetermined coefficient Kloss to each other. In this case, the average value Pav of the accumulator pressure Pa and the average temperature Tav of the hydraulic fluid are calculated as an average value over an entire elapse time tx. The temperature of the hydraulic fluid is a temperature of the pressurized oil detected by the temperature sensor 40 as the temperature detector provided in the portion (for example, in the course of the hydraulic supply and discharge line 33) communicated with the oil chamber 29A of the accumulator 29.

When "NO" is determined at step 16, the estimation gas permeation amount Qloss according to Formula 1 as described above is the permeation gas amount QRP as the threshold value or more. In other words, the gas permeation amount permeating to the oil chamber 29A-side from the gas chamber 29B of the accumulator 29, for example, via a sealing member (not shown) or the like exceeds the threshold value. Particularly, as the temperature of the accumulator 29 increases to be high, the permeation amount of the gas via the sealing member may possibly increase. Also in this case, when "NO" is determined at step 16, at the next step 12 the degradation determination of the accumulator 29 is performed, and at step 13 the display monitor 43 is caused to display the accumulator degradation warning.

In a case where "YES" is determined at step 16, since the estimation gas permeation amount Qloss does not reach the permeation gas amount QRP as the threshold value, at the next step 17, it is determined whether or not the estimation sealed gas pressure Pgs of the gas sealed in the gas chamber 29B of the accumulator 29 is a pressure higher than a preset pressure threshold value PgsRP. The estimation sealed gas pressure Pgs is found as a pressure equal to an initial pressure Pgs of the accumulator pressure Pa shown in the characteristic line 48 from the rising characteristic (the characteristic line 49 in FIG. 9) when the pressurized oil starts to be accumulated in the accumulator 29.

When "NO" is determined at step 17, the estimation sealed gas pressure Pgs of the accumulator 29 is lowered until the preset pressure threshold value PgsRP. In other words, the pressure of the pressurized gas sealed in the gas chamber 29B of the accumulator 29 is lowered to the threshold value or less. Also in this case, the degradation determination of the accumulator 29 is performed at step 12, and at step 13 the display monitor 43 is caused to display the accumulator degradation warning. When "YES" is determined at step 17, the process returns at step 14, and the process after step 11 continues to be executed.

Thus, according to the present embodiment, the controller 45 has the valve control section 46 and the accumulator degradation determination processing section 47. The accumulator degradation determination processing section 47 is provided with, as described before, the elapse time measuring section 47A (refer to step 11 in FIG. 8), the number-of-operations measuring section 47B (refer to step 15 in FIG. 8), the gas permeation amount estimating section 47C (refer to step 16 in FIG. 8), the sealed gas pressure estimating section 47D (refer to step 17 in FIG. 8), and the accumulator degradation determining section 47E (refer to steps 12 and 13 in FIG. 8).

Thereby, it is possible to determine the degradation condition of the accumulator 29 based upon the elapse time tx elapsed or the number of operations N since the initial use of the accumulator 29, the estimation gas permeation amount Qloss or the estimation sealed gas pressure Pgs of the accumulator 29. In addition, it is possible to notify the operator of the result of the degradation determination before the accumulator 29 is actually broken. Further, it is possible to prompt the replacement of the accumulator 29 as needed. Thereby, it is possible to improve the convenience and reliability as the hydraulic energy recovery apparatus.

Accordingly, according to the present invention, the degradation degree of the accumulator 29 can be determined based upon the elapse time tx since the initial use of the accumulator 29, the number of operations N, the average pressure (the average value Pav of the accumulator pressure Pa), or the average temperature (the average temperature Tav of the hydraulic fluid). This estimation (the determination) can be informed to the operator by the display monitor 43 and/or the notification device in the voice synthesizer. Therefore, the operator can execute the replacement of the accumulator 29 before the performance degradation is remarkably progressed to prevent an operational efficiency of the hydraulic drive device including the hydraulic cylinder 5D from being lowered.

In addition, the estimation sealed gas pressure Pgs is found based upon the pressure characteristic at the rising time of the accumulator 29, and a reduction in the sealed gas pressure is informed to the operator by the display monitor 43. Therefore, the operator can catch the abnormality of the accumulator 29 with accuracy to the broken form in which the sealed gas pressure is lowered by the gas permeation from the sealing member in the accumulator 29, and the early replacement of the accumulator 29 can be prompted.

It should be noted that the embodiment is explained by taking a case where the pressurized oil in the accumulator 29 is returned to the main delivery line 15-side of the main hydraulic circuit 11A, as an example. However, the present invention is not limited thereto, but the pressurized oil in the accumulator 29 may be returned to any place as long as it is returned to the main hydraulic circuit 11A under high pressure. For example, the pressurized oil may be configured to be returned to another hydraulic actuator such as the arm cylinder 5E, the bucket cylinder 5F and the like. In addition, as regards the hydraulic actuator configured to recover the pressurized oil, without limitation to the boom cylinder 5D, the pressurized oil from another hydraulic actuator such as the arm cylinder 5E, the bucket cylinder 5F and the like may be recovered (accumulated) into the accumulator 29.

In addition, the above embodiment is explained by taking a case where the pilot hydraulic pump 20 is driven by the engine 12, as an example. However, the present invention is not limited thereto, but, for example, the pilot hydraulic pump may be driven by an electric motor, separately from the main hydraulic pump. In this case, when the pressurized oil is supplied from the actuator to the pilot hydraulic circuit, the rotation of the electric motor can be reduced or stopped.

Further, the above embodiment is explained by taking the engine-operated hydraulic excavator 1 driven by the engine 12 as an example of the working machine. However, the present invention is not limited thereto, but, the present invention is applicable to, for example, a hybrid hydraulic excavator driven by an engine and an electric motor, as well as an electrically powered hydraulic excavator. Further, the present invention is not limited to the hydraulic excavator, but may be widely applied to a variety of working machines such as a wheel loader, a hydraulic crane, a bulldozer and the like.

DESCRIPTION OF REFERENCE NUMERALS

1: Hydraulic excavator (Working machine)
5D: Boom cylinder (Hydraulic actuator)

11A: Main Hydraulic circuit
11B: Pilot Hydraulic circuit
13: Main Hydraulic pump (Main pump)
20: Pilot Hydraulic pump
24: Operation lever device
29: Accumulator
31: Recovery control valve
34: Supply and discharge control valve
35: Main regeneration line
37: Pilot regeneration line
38: Solenoid proportional pressure reducing valve
39: Accumulation side pressure sensor (Pressure detector)
40: Temperature sensor (Temperature detector)
43: Display monitor (Notification device)
44: Reset switch (Reset device)
45: Controller
46: Valve control section
47: Accumulator degradation determination processing section
47A: Elapse time measuring section
47B: Number-of-operations measuring section
47C: Gas permeation amount estimating section
47D: Sealed gas pressure estimating section
47E: Accumulator degradation determining section

The invention claimed is:

1. A hydraulic energy recovery apparatus for a working machine comprising:

a main pump that is driven by a prime mover mounted on a working machine and delivers a hydraulic fluid as pressurized oil;

a hydraulic actuator that is driven by the pressurized oil delivered from the main pump; and an accumulator that recovers a part or all of returned oil from the hydraulic actuator, wherein the hydraulic energy recovery apparatus for the working machine includes:

a pressure sensor that detects a pressure of the accumulator;

a temperature sensor that detects a temperature of the hydraulic fluid;

a reset device that is reset at a time of a replacement of the accumulator; and a controller to which signals from an operation lever device configured to operate the hydraulic actuator, the pressure sensor, the temperature sensor, and the reset device are input, and wherein the controller includes:

an elapse time measuring section that measures a time elapsed since an initial use of the accumulator based upon a signal from the reset device;

a number-of-operations measuring section that measures a number of operations of the accumulator based upon a signal from the pressure sensor;

a gas permeation amount estimating section that estimates a gas permeation amount of the accumulator based upon outputs from the elapse time measuring section, the pressure sensor, and the temperature sensor;

a sealed gas pressure estimating section that estimates a sealed gas pressure of the accumulator from a rising state of an accumulator pressure in a case of starting accumulation from a state where the accumulator pressure is equal to a tank pressure, based upon the signal from the pressure sensor; and an accumulator degradation determining section that determines a degradation condition of the accumulator based upon at least one output of outputs from the elapse time measuring section, the number-of-operations measuring section, the gas permeation amount estimating section, and the sealed gas pressure estimating section, and outputs the determination result.

2. The hydraulic energy recovery apparatus for the working machine according to claim 1, further comprising:

a notification device for issuing a warning, wherein the controller causes the notification device to operate when the accumulator degradation determining section determines degradation of the accumulator.

3. A hydraulic energy recovery apparatus for a working machine comprising:

a main pump that is driven by a prime mover mounted on a working machine and delivers a hydraulic fluid as pressurized oil;

a hydraulic actuator that is driven by the pressurized oil delivered from the main pump; and an accumulator that recovers returned oil from the hydraulic actuator, wherein the hydraulic energy recovery apparatus for the working machine includes:

a pressure sensor that detects a pressure of the accumulator;

a temperature sensor that detects a temperature of the hydraulic fluid;

a reset device that is reset at the time of the replacement of the accumulator; and a controller to which signals from the pressure sensor, the temperature sensor, and the reset device are input, and wherein the controller includes:

an elapse time measuring section that measures a time elapsed since an initial use of the accumulator based upon the signal from the reset device;

a gas permeation amount estimating section that estimates a gas permeation amount of the accumulator based upon outputs from the elapse time measuring section, the pressure sensor, and the temperature sensor; and an accumulator degradation determining section that determines a degradation condition of the accumulator based upon the output from the gas permeation amount estimating section, and outputs the determination result.

4. The hydraulic energy recovery apparatus for the working machine according to claim 3, further comprising:

a notification device for issuing a warning, wherein the controller causes the notification device to operate when the accumulator degradation determining section determines degradation of the accumulator.

* * * * *